US007107804B2

(12) United States Patent
Gong et al.

(10) Patent No.: US 7,107,804 B2
(45) Date of Patent: Sep. 19, 2006

(54) METHODS OF AND APPARATUS FOR PRESSURE-RAM-FORMING METAL CONTAINERS AND THE LIKE

(75) Inventors: Kevin Gong, Kingston (CA); Peter Hamstra, Kingston (CA); Stuart MacEwen, Inverary (CA); Robert Mallory, Gananoque (CA); James D. Moulton, Kingston (CA)

(73) Assignee: Novelis Inc., Toronto (CA)

( * ) Notice: Subject to any disclaimer, the term of this patent is extended or adjusted under 35 U.S.C. 154(b) by 245 days.

(21) Appl. No.: 10/788,636

(22) Filed: Feb. 26, 2004

(65) Prior Publication Data

US 2004/0187536 A1 Sep. 30, 2004

Related U.S. Application Data

(63) Continuation of application No. 10/284,912, filed on Oct. 31, 2002, now Pat. No. 6,802,196, which is a continuation-in-part of application No. 10/007,263, filed on Nov. 8, 2001, now abandoned, which is a continuation-in-part of application No. 09/846,546, filed on May 1, 2001, now abandoned.

(30) Foreign Application Priority Data

May 1, 2002 (CA) ..... PCT/CA02/00644

(51) Int. Cl.
*B21D 26/02* (2006.01)

(52) U.S. Cl. ..... 72/58; 72/61; 72/62; 29/421.1

(58) Field of Classification Search ..... 72/58, 72/61, 62; 29/421.1
See application file for complete search history.

(56) References Cited

U.S. PATENT DOCUMENTS

| | | | |
|---|---|---|---|
| 840,091 | A | 1/1907 | Schmacher et al. |
| 2,238,037 | A | 4/1941 | Cornell, Jr. |
| 2,592,867 | A | 4/1952 | Cuq |
| 3,040,684 | A | 6/1962 | Hillgren |
| 3,681,960 | A | 8/1972 | Tadokoro |
| 3,896,648 | A | 7/1975 | Schertenlieb |
| 3,919,871 | A | 11/1975 | Andrasev et al. |

(Continued)

FOREIGN PATENT DOCUMENTS

| | | |
|---|---|---|
| DE | 3 716 176 | 9/1988 |

(Continued)

*Primary Examiner*—David B. Jones
(74) *Attorney, Agent, or Firm*—Cooper & Dunham LLP

(57) ABSTRACT

A method of forming a bottle-shaped or other contoured metal container by subjecting a hollow metal preform having a closed end to internal fluid pressure to cause the preform to expand against the wall of a die cavity defining the desired shape, and advancing a punch by means of a backing ram into the die cavity to displace and deform the closed end of the preform either before or after expansion begins but before it is complete. The pressure-subjecting step is performed by simultaneously subjecting the preform in the die cavity to independently controllable internal and external positive fluid pressures and varying the difference between them to control strain rate. Apparatus for performing the method includes a split die with plural split inserts disposed in tandem to define the die cavity wall and heaters respectively inserted within the preform and arranged to heat the backing ram.

57 Claims, 14 Drawing Sheets

U.S. PATENT DOCUMENTS

| | | | | |
|---|---|---|---|---|
| 4,265,102 | A | 5/1981 | Shimakata et al. | |
| 4,362,037 | A | 12/1982 | Whitfield | |
| 4,774,826 | A | 10/1988 | Hann | |
| 5,187,962 | A | 2/1993 | Bilko et al. | |
| 5,778,723 | A | 7/1998 | Diekhoff et al. | |
| 5,822,843 | A | 10/1998 | Diekhoff et al. | |
| 5,829,290 | A | 11/1998 | Harvey | |
| 5,832,766 | A | 11/1998 | Hartman et al. | |
| 5,992,197 | A | 11/1999 | Freeman et al. | |
| 6,182,487 | B1 | 2/2001 | Komiya et al. | |
| 6,802,196 | B1 * | 10/2004 | Gong et al. | 72/58 |

FOREIGN PATENT DOCUMENTS

| | | |
|---|---|---|
| EP | 0 740 971 | 11/1996 |
| JP | 46-26784 | 8/1971 |
| JP | 10-146879 | 6/1998 |
| JP | 10-146880 | 6/1998 |

* cited by examiner

METHODS OF AND APPARATUS FOR PRESSURE-RAM-FORMING METAL CONTAINERS AND THE LIKE

CROSS REFERENCE TO RELATED APPLICATIONS

This application is a continuation of U.S. patent application Ser. No. 10/284,912, filed Oct. 31, 2002, now U.S. Pat. No. 6,802,196, which is a continuation-in-part of U.S. patent application Ser. No. 10/007,263, filed Nov. 8, 2001 (now abandoned), and of international application No. PCT/CA 02/00644 filed May 1, 2002, designating the United States, which is also a continuation-in-part of the aforesaid U.S. patent application Ser. No. 10/007,263 (now abandoned), which is a continuation-in-part of U.S. patent application Ser. No. 09/846,546, filed May 1, 2001 (now abandoned), the entire disclosure of each of which is incorporated herein by this reference.

BACKGROUND OF THE INVENTION

This invention relates to methods of and apparatus for forming metal containers or the like, utilizing internal fluid pressure to expand a hollow metal preform or workpiece against a die cavity. In an important specific aspect, the invention is directed to methods of and apparatus for forming aluminum or other metal containers having a contoured shape, e.g. such as a bottle shape with asymmetrical features.

Metal cans are well known and widely used for beverages. Present day beverage can bodies, whether one-piece "drawn and ironed" bodies, or bodies open at both ends (with a separate closure member at the bottom as well as at the top), generally have simple upright cylindrical side walls. It is sometimes desired, for reasons of aesthetics, consumer appeal and/or product identification, to impart a different and more complex shape to the side wall and/or bottom of a metal beverage container, and in particular, to provide a metal container with the shape of a bottle rather than an ordinary cylindrical can shape. Conventional can-producing operations, however, do not achieve such configurations.

For these and other purposes, it would be advantageous to provide convenient and effective methods of forming workpieces into bottle shapes or other complex shapes. Moreover, it would be useful to provide such procedures capable of forming contoured container shapes that are not radially symmetrical, to enhance the variety of designs obtainable.

SUMMARY OF THE INVENTION

The present invention in a first aspect broadly contemplates the provision of a method of forming a metal container of defined shape and lateral dimensions, comprising disposing a hollow metal preform having a closed end in a die cavity laterally enclosed by a die wall defining the shape and lateral dimensions, with a punch located at one end of the cavity and translatable into the cavity, the preform closed end being positioned in proximate facing relation to the punch and at least a portion of the preform being initially spaced inwardly from the die wall; subjecting the preform to internal fluid pressure to expand the preform outwardly into substantially full contact with the die wall, thereby to impart the defined shape and lateral dimensions to the preform, the fluid pressure exerting force, on the preform closed end, directed toward the aforesaid one end of the cavity; and, either before or after the preform begins to expand but before expansion of the preform is complete, translating the punch into the cavity to engage and displace the closed end of the preform in a direction opposite to the direction of force exerted by fluid pressure thereon, deforming the closed end of the preform. Translation of the punch is effected by a ram which is capable of applying sufficient force to the punch to displace and deform the preform. This method will sometimes be referred to herein as a pressure-ram-forming (PRF) procedure, because the container is formed both by applied internal fluid pressure and by the translation of the punch by the ram.

As a further feature of the invention, the punch has a contoured surface, and the closed end of the preform is deformed so as to conform to the contoured surface. For instance, the punch may have a domed contour, the closed end of the preform being deformed into the domed contour.

The defined shape, in which the container is formed, may be a bottle shape including a neck portion and a body portion larger in lateral dimensions than the neck portion, the die cavity having a long axis, the preform having a long axis and being disposed substantially coaxially within the cavity, and the punch being translatable along the long axis of the cavity.

Advantageously and preferably, the die wall comprises a split die separable for removal of the formed container. The term "split die" as used herein refers to a die made up of two or more mating segments around the periphery of the die cavity. With a split die, the defined shape may be asymmetric about the long axis of the cavity.

The punch is preferably initially positioned close to or in contact with the preform closed end, before the application of fluid pressure, in order to limit axial lengthening of the preform by the fluid pressure. Translation of the punch may be initiated after the expanding lower portion of the preform has come into contact with the die wall.

The preform, for forming a bottle-shaped container or the like, is preferably an elongated and initially generally cylindrical workpiece having an open end opposite its closed end. In particular embodiments of the invention, it may be substantially equal in diameter to the neck portion of the bottle shape, and may have sufficient formability to be expandable to the defined shape in a single pressure forming operation. If it lacks such formability, preliminary steps of placing the. workpiece in a die cavity smaller than the first-mentioned die cavity, and subjecting the workpiece therein to internal fluid pressure to expand the workpiece to an intermediate size and shape smaller than the defined shape and lateral dimensions, are performed prior to the PRF method described above.

Alternatively, if the elongated and initially generally cylindrical workpiece is larger in initial diameter than the neck portion of the bottle shape, the method of forming a bottle-shaped container may include a further step of subjecting the workpiece, adjacent its open end, to a necking operation to form a neck portion of reduced diameter, after performance of the PRF procedure.

Alternatively, the diameter of the neck area of the preform is reduced using a die necking procedure. This die necking procedure could be applied before the expansion stage.

The preform may be an aluminum preform (the term "aluminum" herein being used to refer to aluminum-based alloys as well as pure aluminum metal) and may be made from aluminum sheet having a recrystallized or recovered microstructure with a gauge in a range of about 0.25 to about 1.5 mm. It may be produced as a closed end cylinder by subjecting the sheet to a draw-redraw operation or back extrusion.

During the step of subjecting the preform to internal fluid pressure, the fluid pressure within the preform occurs in successive stages of (i) rising to a first peak before expansion of the preform begins, (ii) dropping to a minimum value as expansion. commences, (iii) rising gradually to an intermediate value as expansion proceeds until the preform is in extended though not complete contact with the die wall, and (iv) rising from the intermediate pressure during completion of preform expansion. Stated with reference to this sequence of pressure stages, the initiation of translation of the punch to displace and deform the closed end of the preform in a preferred embodiment of the invention occurs substantially at the end of stage (iii).

Typically, when the internal fluid pressure is applied, the closed end of the preform assumes an enlarged and generally hemispherical configuration as the preform comes into contact with the die wall; and initiation of translation of the punch occurs substantially at the time that the preform closed end assumes this configuration.

Also in accordance with the invention, the step of subjecting the preform to internal fluid pressure comprises simultaneously applying internal positive fluid pressure and external positive fluid pressure to the preform in the cavity, the internal positive fluid pressure being higher than the external positive fluid pressure. The internal and external pressure are respectively provided by two independently controllable pressure systems. Strain rate in the preform is controlled by independently controlling the internal and external positive fluid pressures to which the preform is simultaneously subjected for varying the differential between the internal positive fluid pressure and the external positive fluid pressure. In this way, more precise control of the strain rates may be achieved. In addition, the increased hydrostatic pressure may reduce deleterious effects of damage (voids) associated with the microstructure of the material.

According to a still further feature of the invention, it has been found to be advantageous to apply heat during expansion of the preform, such as to induce a temperature gradient in the preform. By adding heaters to the punch, a temperature gradient is induced in the preform from the bottom up. Separate heaters may be added at the top of the die which induce a temperature gradient in the preform from the top down. Further heaters may be included in the side walls of the die cavity.

It has also been found to be advantageous to have the punch in contact with the bottom of the preform before the start of the expansion phase and to apply some axial load by the punch throughout the expansion phase. With this procedure where the punch applies some axial load to the closed end of the preform throughout the expansion phase, the displacement and deformation of the preform closed end are preferably not carried out until completion of the expansion phase.

Also in accordance with the invention, the aforementioned split die may comprise a plurality of split inserts disposed in tandem along the axis of the die cavity for defining successive portions of the defined container shape and separable for removal of the formed container. Conveniently the split inserts are removably and replaceably received within a split holder that maintains the inserts in fixed die-cavity-defining position during expansion of the preform. At least one of the inserts may have an inner surface bearing a relief feature for imparting a corresponding relief feature to the container; the method of the invention may include the additional step of selecting one or more inserts from a group of interchangeable inserts having inner surfaces respectively bearing different relief features, and disposing the selected insert or inserts in the split holder for forming a container.

Internal and external positive fluid pressures may be applied by feeding gas to the interior of the preform and to the die cavity externally of the preform, respectively, through separate channels. Heat may be applied to the preform by multiple groups of heating elements respectively incorporated in upper and lower portions of the die structure and under independent temperature control for controlling temperature gradient in the preform. Additionally or alternatively, heat may be applied to the preform by a heating element disposed within the preform substantially coaxially therewith; and heat may be further supplied to the preform by heating the punch.

In addition, where the neck portion of the desired defined container shape includes a screw thread or lug for securing a screw closure to the formed container, and/or a neck ring, the die wall may have a neck portion with a thread or lug formed therein for imparting a thread to the preform during expansion of the preform.

The invention in a further aspect contemplates the provision of apparatus for forming a metal container of defined shape and lateral dimensions from a hollow metal preform having a closed end, comprising die structure providing a die cavity for receiving the preform therein with at least a portion of the preform being initially spaced inwardly from the die wall and the preform closed end facing one end of the cavity, the cavity having a die wall defining the aforesaid shape and lateral dimensions; a punch located at one end of the cavity and translatable into the cavity such that the closed end of a preform received within the cavity is positioned in proximate facing relation to the punch; and a fluid pressure supply for subjecting a preform within the cavity to internal fluid pressure to expand the preform outwardly into substantially full contact with the die wall, thereby to impart the aforesaid defined shape and lateral dimensions to the preform, the fluid pressure exerting force, on the closed end of the preform, directed toward the aforesaid one end of the cavity, the die cavity having a second end opposed to the aforesaid one end and an axis extending therebetween; wherein the die wall comprises a split die including a plurality of split inserts disposed in tandem along the axis for defining successive portions of the aforesaid defined shape and separable for removal of the formed container from the cavity. This apparatus may also include one or more of the additional features of the inserts, insert holders, heating and pressure arrangements, and neck thread or lug forming arrangements, described above with reference to the method of the invention.

Further features and advantages of the invention will be apparent from the detailed description hereinafter set forth, together with the accompanying drawings.

DETAILED DESCRIPTION

The invention will be described as embodied in methods of forming aluminum containers having a contoured shape that need not be axisymmetric (radially symmetrical about a geometric axis of the container) using a combination of hydro (internal fluid pressure) and punch forming, i.e., a PRF procedure.

The PRF manufacturing process has two distinct stages, the making of a preform and the subsequent forming of the preform into the final container. There are several options for the complete forming path and the appropriate choice is determined by the formability of the aluminum sheet being used.

The preform is made from aluminum sheet having a recrystallized or recovered microstructure and with a gauge, for example, in the range of 0.25 mm to 1.5 mm. The preform is a closed-end cylinder that can be made by, for example, a draw-redraw process or by back-extrusion. The diameter of the preform lies somewhere between the minimum and maximum diameters of the desired container product. Threads may be formed on the preform prior to the subsequent forming operations. The profile of the closed end of the preform may be designed to assist with the forming of the bottom profile of the final product.

Figure 1:
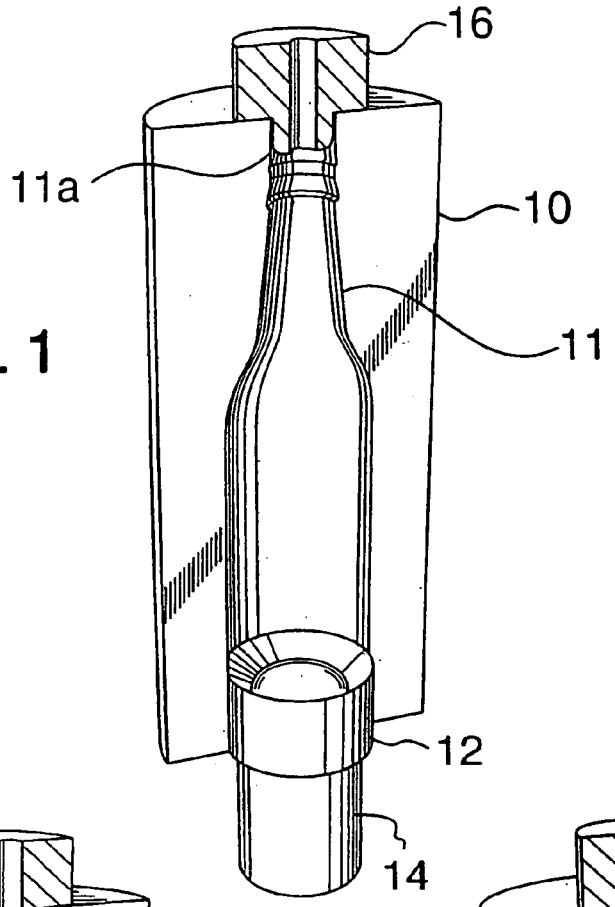
FIG. 1 is a simplified and somewhat schematic perspective view of tooling for performing the method of the present invention, in illustrative embodiments.

As illustrated in FIG. 1, the tooling assembly for the method of the invention includes a split die 10 with a profiled cavity 11 defining an axially vertical bottle shape, a punch 12 that has the contour desired for the bottom of the container (for example, in the illustrated embodiments, a convexly domed contour for imparting a domed shape to the bottom of the formed container) and a ram 14 that is attached to the punch. In FIG. 1, only one of the two halves of the split die is shown, the other being a mirror image of the illustrated die half; as will be apparent, the two halves meet in a plane containing the geometric axis of the bottle shape defined by the wall of the die cavity The minimum diameter of the die cavity 11, at the upper open end 11*a* thereof (which corresponds to the neck of the bottle shape of the cavity) is equal to the outside diameter of the preform (see FIG. 2A) to be placed in the cavity, with allowance for clearance. The preform is initially positioned slightly above the punch 12 and has a schematically represented pressure fitting 16 at the open end 11*a* to allow for internal pressurization. Pressurization can be achieved, for example, by a coupling to threads formed in the upper open end of the preform, or by inserting a tube into the open end of the preform and making a seal by means of the split die or by some other pressure fitting.

The pressurizing step involves introducing, to the interior of the hollow preform, a fluid such as water or air under pressure sufficient to cause the preform to expand within the cavity until the wall of the preform is pressed substantially fully against the cavity-defining die wall, thereby imparting the shape and lateral dimensions of the cavity to the expanded, preform. Stated generally, the fluid employed may be compressible or noncompressible, with any of mass, flux, volume or pressure controlled to control the pressure to which the preform walls are thereby subjected. In selecting the fluid, it is necessary to take into account the temperature conditions to be employed in the forming operation; if water is the fluid, for example, the temperature must be less than 100° C., and if a higher temperature is required, the fluid should be a gas such as air, or a liquid that does not boil at the temperature of the forming operation.

As a result of the pressurizing step, detailed relief features formed in the die wall are reproduced in inverse mirror-image form on the surface of the resultant container. Even if such features, or the overall shape, of the produced container are not axisymmetric, the container is removed from the tooling without difficulty owing to the use of a split die.

Figure 2A:
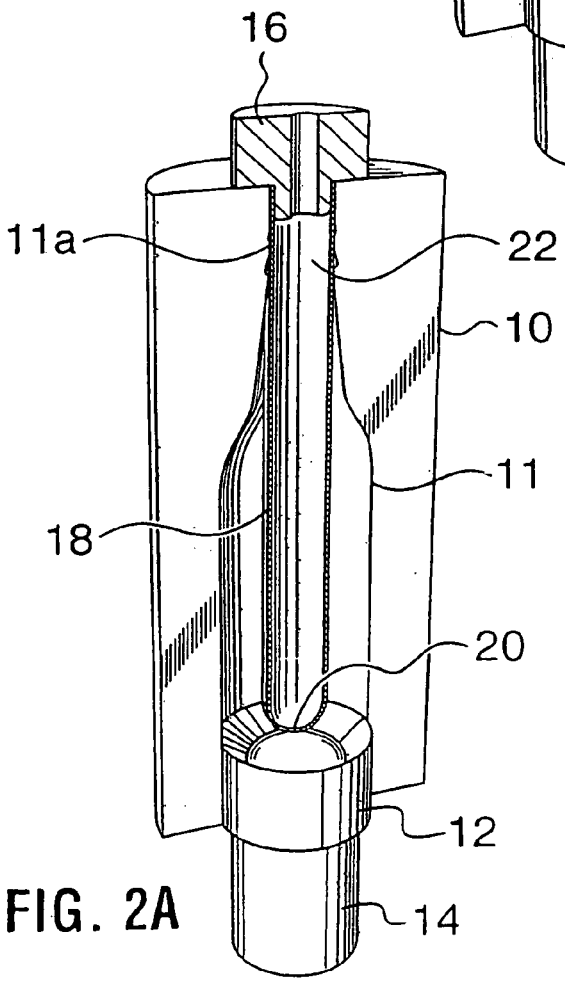
FIGS. 2A and 2B are views similar to FIG. 1 of sequential stages in the performance of a first embodiment of the method of the invention.
Figure 2B:
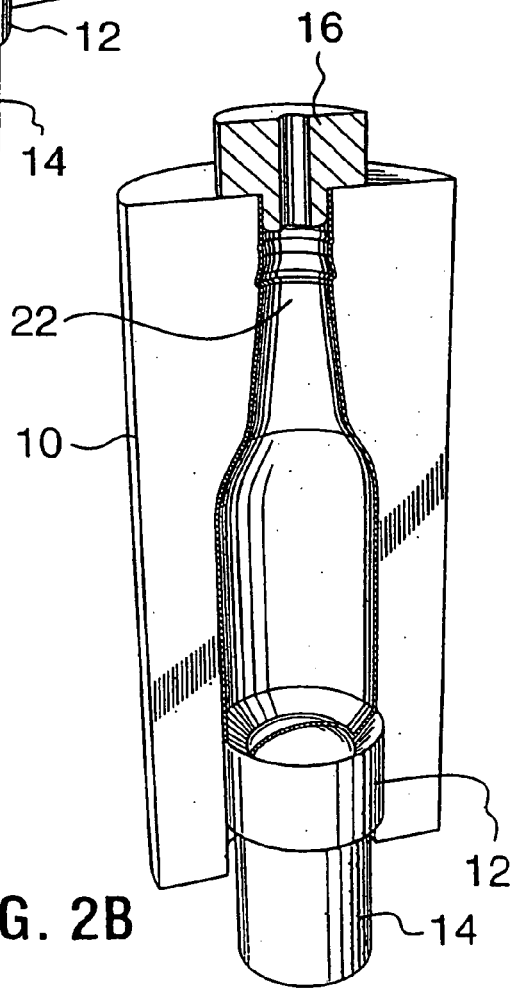

In the specific embodiment of the invention illustrated in FIGS. 2A and 2B, the preform 18 is a hollow cylindrical aluminum workpiece with a closed lower end 20 and an open upper end 22, having an outside diameter equal to the outside diameter of the neck of the bottle shape to be formed, and the forming strains of the PRF operation are within the bounds set by the formability of the preform (which depends on temperature and deformation rate). With a preform having this property of formability, the shape of the die cavity 11 is made exactly as required for the final product and the product can be made in a single PRF operation. The motion of the ram 14 and the rate of internal pressurization are such as to minimize the strains of the forming operation and to produce the desired shape of the container. Neck and side-wall features result primarily from the expansion of the preform due to internal pressure, while the shape of the bottom is defined primarily by the motion of the ram and punch 12, and the contour of the punch surface facing the preform closed end 20.

Figure 3:
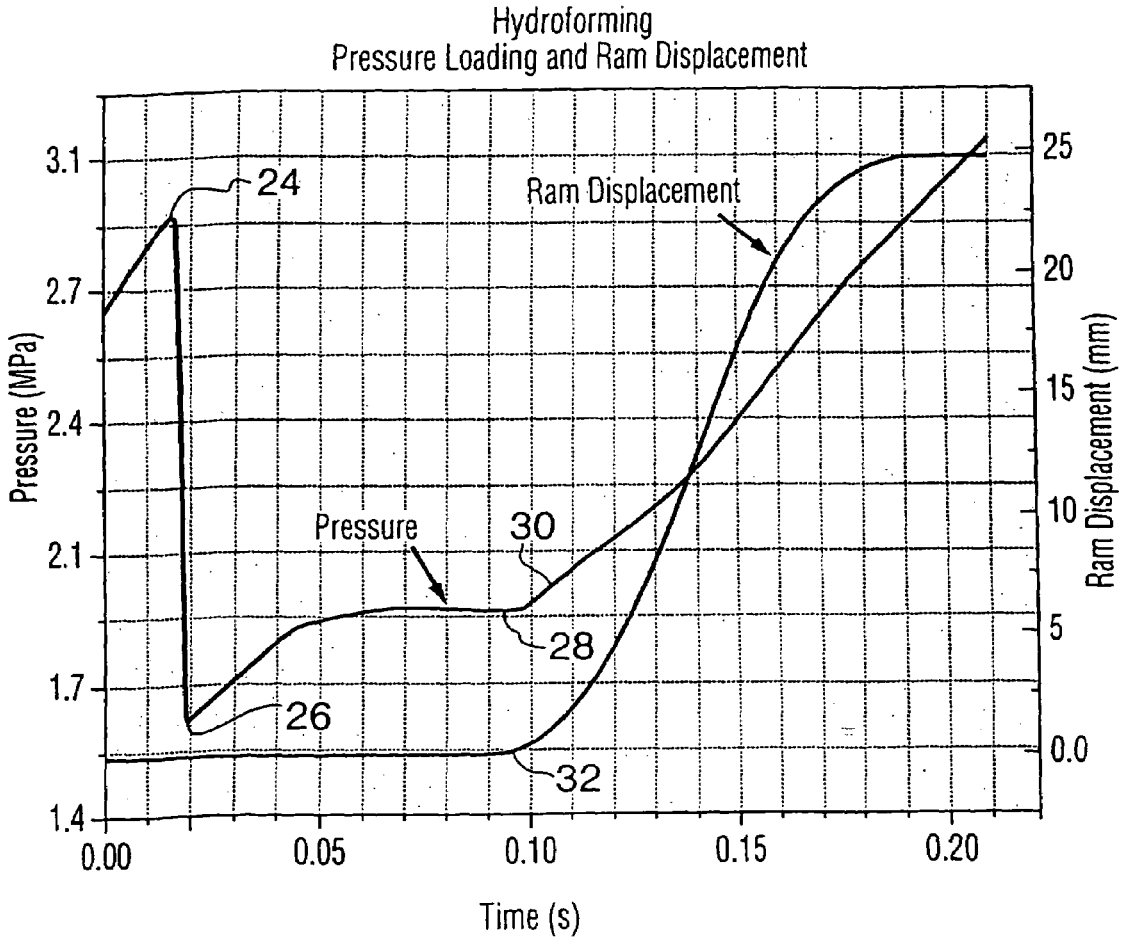
FIG. 3 is a graph of internal pressure and ram displacement as functions of time, using air as the fluid medium, illustrating the time relationship between the steps of subjecting the preform to internal fluid pressure and translating the punch in the method of the invention.
Figure 4A:
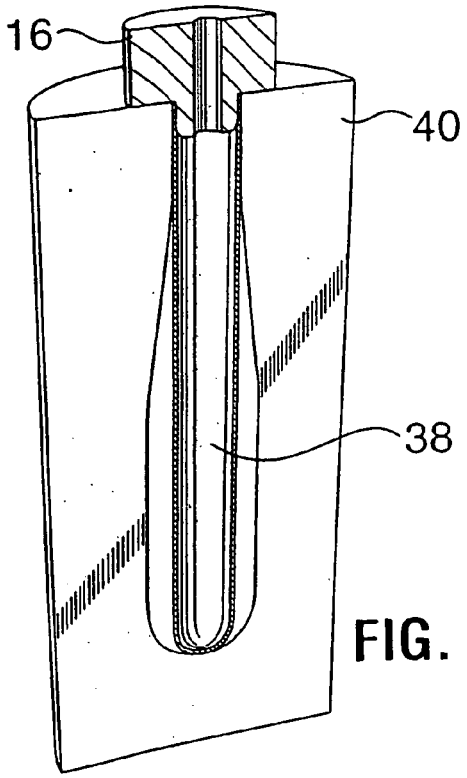
FIGS. 4A, 4B, 4C and 4D are views similar to FIG. 1 of sequential stages in the performance of a second embodiment of the method of the invention.
Figure 4B:
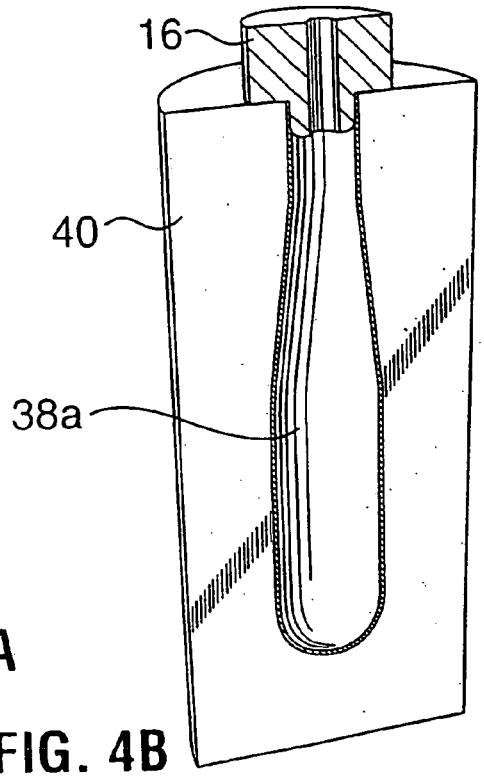
Figure 4C:
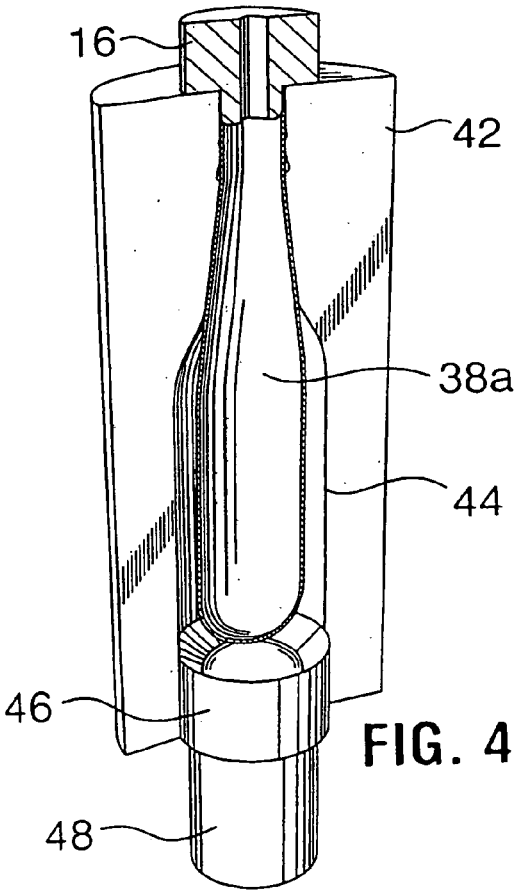
Figure 4D:
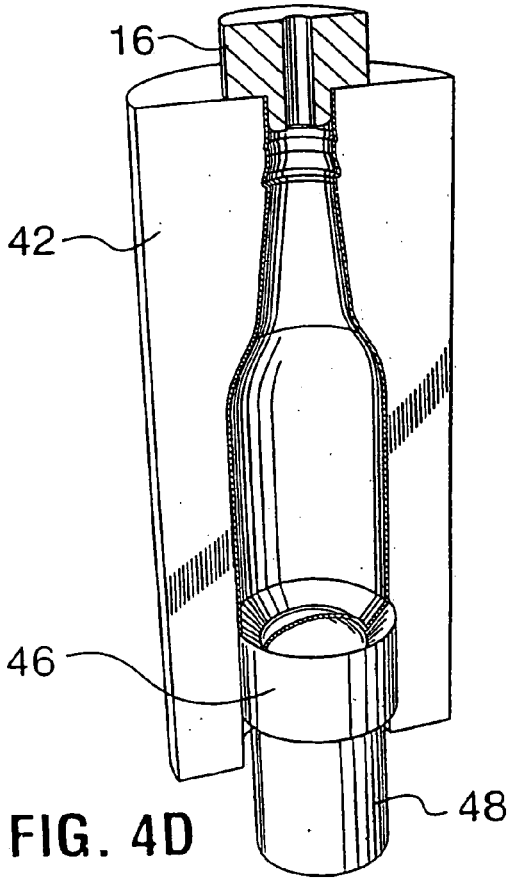

Proper synchronization of the application of internal fluid pressure and operation (translation into the die cavity) of the ram and punch are important in the practice of the invention. FIG. 3 shows a plot of computer-generated simulated data (sequence of finite element analysis outputs) representing the forming operation of FIGS. 2A and 2B with air pressure, controlled by flux. Specifically, the graph illustrates the pressure and ram time histories involved. As will be apparent from FIG. 3, the fluid pressure within the preform occurs in successive stages of (i) rising to a first peak 24 before expansion of the preform begins, (ii) dropping to a minimum value 26 as expansion commences, (iii) rising gradually to an intermediate value 28 as expansion proceeds until the preform is in extended though not complete contact with the die wall, and (iv) rising more rapidly (at 30) from the intermediate value during completion of preform expansion. Stated with reference to this sequence of pressure stages, the initiation of translation of the punch to displace and deform the closed end of the preform in preferred embodiments of the invention occurs (at 32) substantially at the end of stage (iii). Time, pressure and ram displacement units are indicated on the graph. The effect of the operations represented in FIG. 3 on the preform (in a computer generated simulation) is shown in FIGS. 6A, 6B, 6C and 6D for times 0.0, 0.096, 0.134 and 0.21 seconds as represented on the x-axis of FIG. 3.

At the outset of introduction of internal fluid pressure to the hollow preform, the punch 12 is disposed beneath the closed end of the preform (assuming an axially vertical orientation of the tooling, as shown) in closely proximate (e.g. touching) relation thereto, so as to limit axial stretching of the preform under the influence of the supplied internal pressure. When expansion of the preform attains a substantial though not fully complete degree, the ram 14 is actuated to forcibly translate the punch upwardly, displacing the metal of the closed end of the preform upwardly and deforming the closed end into the contour of the punch surface, as the lateral expansion of the preform by the internal pressure is completed. The upward displacement of the closed preform end, in these described embodiments, does not move the preform upwardly relative to the die or cause the side wall of the preform to buckle (as might occur by premature upward operation of the ram) owing to the extent of preform expansion that has already occurred when the ram begins to drive the punch upward.

A second embodiment of the method of the invention is illustrated in FIGS. 4A–4D. In this embodiment, as in that of FIGS. 2A and 2B, the cylindrical preform 38 has an initial outside diameter equal to the minimum diameter (neck) of the final product. However, in this embodiment it is assumed that the forming strains of the PRF operation exceed the formability limits of the preform. In this case, two sequential pressure forming operations are required. The first (FIGS. 4A and 4B) does not require a ram and simply expands the preform within a simple split die 40 to a larger diameter workpiece 38*a* by internal pressurization. The second is a PRF procedure (FIGS. 4C and 4D), starts with the workpiece as initially expanded in the die 40 and, employing a split die 42 with a bottle-shaped cavity 44 and a punch 46 driven by a ram 48, i.e., using both internal pressure and the motion of the ram, produces the final desired bottle shape, including all features of the side-wall profile and the contours of the bottom, which are produced primarily by the action of the punch 46.

Figure 5A:
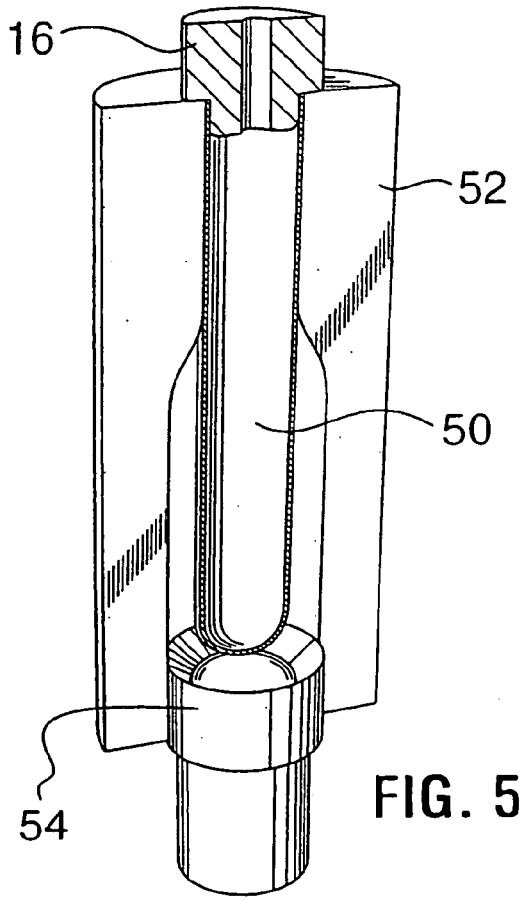
FIGS. 5A and 5B are, respectively, a view similar to FIG. 1 and a simplified, schematic perspective view of a spin-forming step, illustrating sequential stages in the performance of a third embodiment of the invention.
Figure 5B:
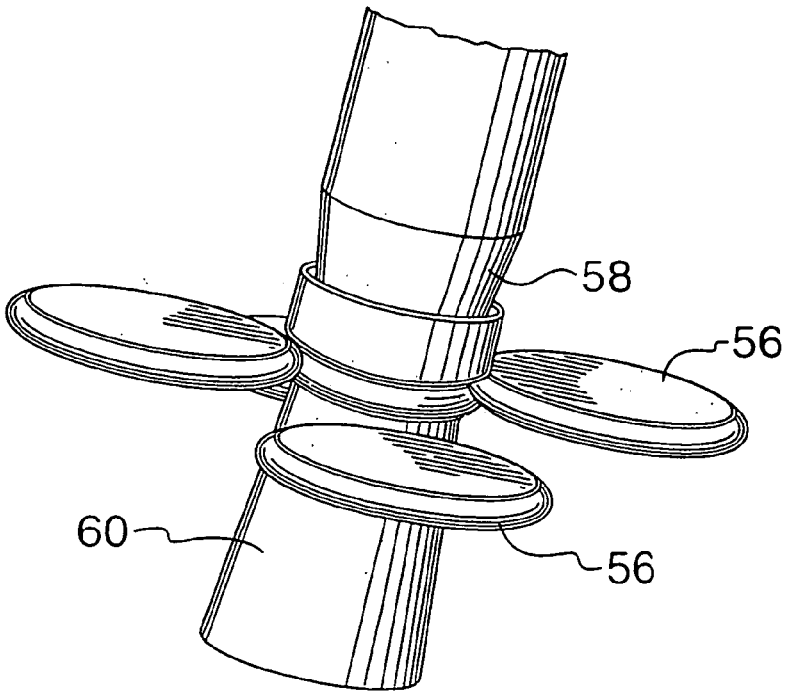

A third embodiment is shown in FIGS. 5A and 5B. In this embodiment, the preform 50 is made with an initial outside diameter that is greater than the desired minimum outside diameter (usually the neck diameter) of the final bottle-shaped container. This choice of preform may result from considerations of the forming limits of the pre-forming operation or may be chosen to reduce the strains in the PRF operation. In consequence, manufacture of the final product must include both diametrical expansion and compression of the preform and thus can not be accomplished with the PRF apparatus alone. A single PRF operation (FIG. 5A, employing split die 52 and ram-driven punch 54) is used to form the wall and bottom profiles (as in the embodiment of FIGS. 2A and 2B) and a spin forming or other necking operation is required to shape the neck of the container. As illustrated in FIG. 5B, one type of spin forming procedure that may be employed is that set forth in U.S. Pat. No. 6,442,988, the entire disclosure of which is incorporated herein by this reference, utilizing plural tandem sets of spin forming discs 56 and a tapered mandrel 58 to shape the bottle neck 60.

In the practice of the PRF procedure described above, PRF strains may be large. Alloy composition is accordingly selected or adjusted to provide a combination of desired product properties and enhanced formability. If still better formability is required, the forming temperature may be adjusted as described hereinafter, since an increase in temperature affords better formability; hence, the PRF operation(s) may need to be conducted at elevated temperatures and/or the preform may require a recovery anneal, in order to increase its formability.

The present invention differs from known pressure-forming operations such as blow-forming of PET containers, in particular, in adding an external punch-forming component. An internal punch, as sometimes used for PET bottle-forming, is not required. At present, there is no way known to applicants to produce an aluminum container with a shaped profile with the range of diameters that can be achieved with the present invention. Furthermore, there is no way currently known to applicants to produce an asymmetric profile (for example, feet on the bottom or spiral ribs on the side of the container).

The method of the invention could also be used to shape containers from other materials, such as steel.

The importance of moving the ram-driven punch 12 into the die cavity 11 to displace and deform the closed end 20 of the preform 18 (as in FIGS. 2A and 2B) may be further explained by reference to FIG. 3 (mentioned above) as considered together with FIGS. 6A–6D, in which the dotted line represents the vertical profile of the die cavity 11, and the displacement (in millimeters) of the dome-contoured punch 12 at various times after the initiation of internal pressure is represented by the scale on the right-hand side of that dotted line.

Figure 6A:
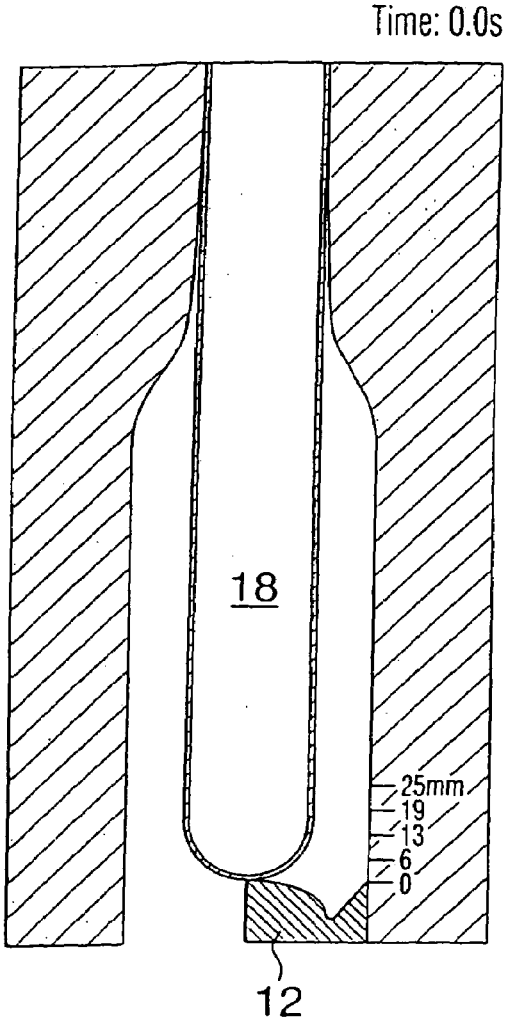
FIGS. 6A, 6B, 6C and 6D are computer-generated schematic elevational views of successive stages in the method of the invention.
Figure 6B:
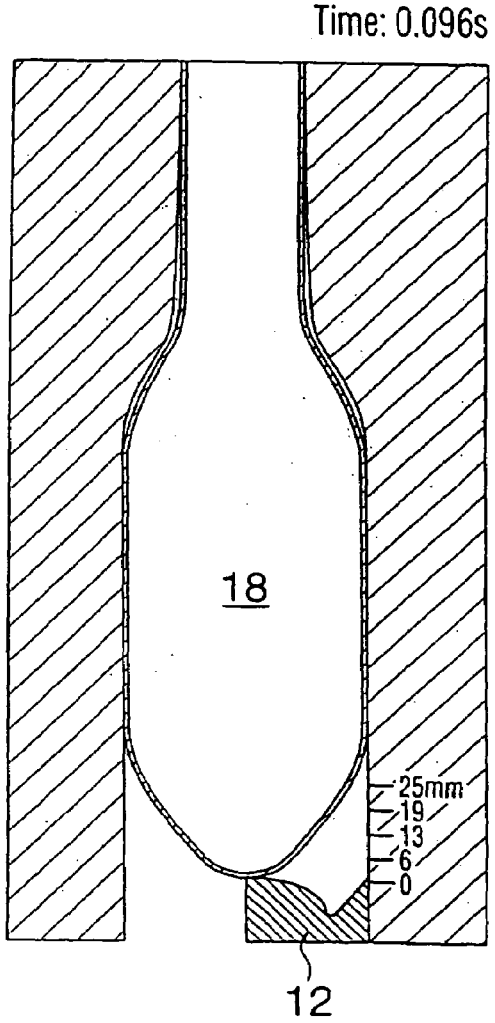
Figure 6C:
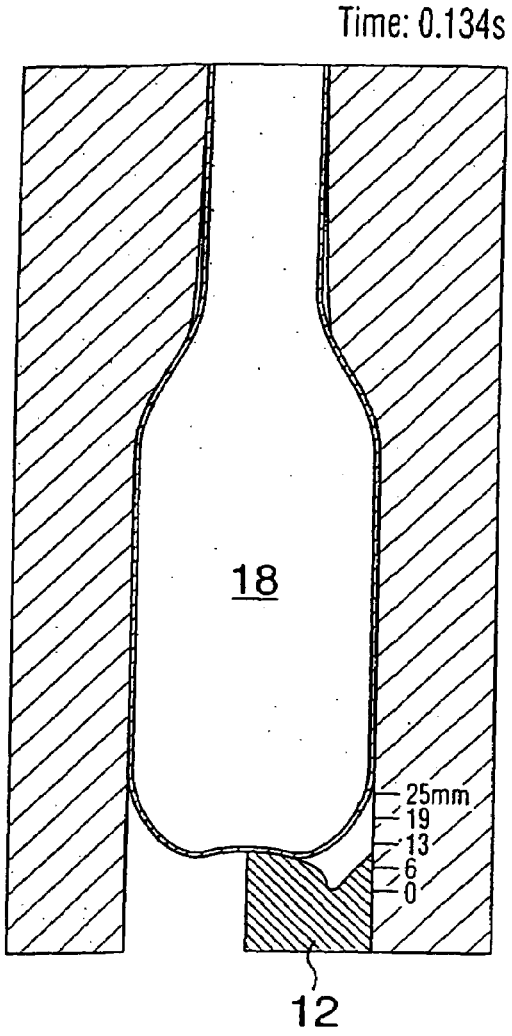
Figure 6D:
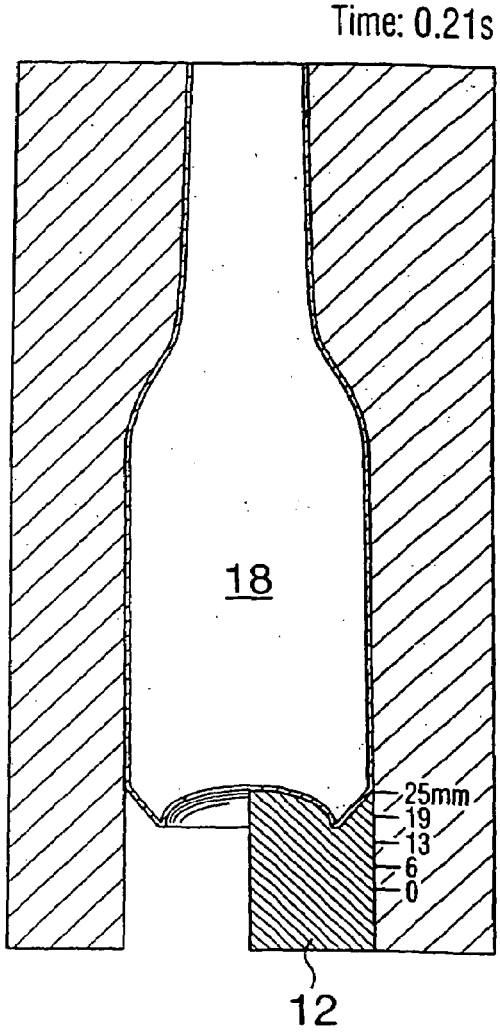

The ram serves two essential functions in the forming of the aluminum bottle. It limits the axial tensile strains and forms the shape of the bottom of the container. Initially the ram-driven punch 12 is held in close proximity to, or just touching, the bottom of the preform 18 (FIG. 6A). This serves to minimize the axial stretching of the preform side wall that would otherwise occur as a result of internal pressurization. Thus, as the internal pressure is increased, the side wall of the preform will expand to contact the inside of the die without significant lengthening. In these described embodiments, the central region of the preform will typically expand first; this region of expansion will grow along the length of the preform, both upward and downward, and at some point in time the bottom of the preform will become nearly hemispherical in shape, with the radius of the hemisphere approximately equal to that of the die cavity (FIG. 6B). It is at or just before this point in time that the ram must be actuated to drive the punch 12 upwards (FIG. 6C). The profile of the nose of the ram (i.e. the punch surface contour) defines completely the profile of the bottom of the container. As the internal fluid pressure completes the molding of the preform against the die cavity wall (compare the bottle-shoulder and neck in FIGS. 6B, 6C and 6D), the motion of the ram, combined with the internal pressure, forces the bottom of the preform into the contours of the punch surface in a manner that produces the desired contour (FIG. 6D) without excessive tensile strains that could, conceivably, lead to failure. The upward motion of the ram applies compressive forces to the hemispherical region of the preform, reduces general strain caused by the pressurizing operation, and assists in feeding material radially outwards to fill the contours of the punch nose.

If the ram motion is applied too early, relative to the rate of internal pressurization, the preform is likely to buckle and fold due to the compressive axial forces. If applied too late, the material will undergo excessive strain in the axial direction causing it to fail. Thus, coordination of the rate of internal pressurization and motion of the ram and punch nose is required for a successful forming operation. The necessary timing is best accomplished by finite element analysis (FEA) of the process. FIG. 3 is based on results of FEA.

The invention has been thus far described, and exemplified in FIG. 3, as if no positive (i.e., superatmospheric) fluid pressure were applied to the outside of the preform within the die cavity. In such a case, the external pressure on the preform in the cavity would be substantially ambient atmospheric pressure. As the preform expands, air in the cavity would be driven out (by the progressive diminution of volume between the outside of the preform and the die wall) through a suitable exhaust opening or passage provided for that purpose and communicating between the die cavity and the exterior of the die.

Stated with specific reference to aluminum containers, by way of illustration, it has been shown by FEA that in the absence of any applied positive external pressure, once the preform starts to deform (flow) plastically, the strain rate in the preform becomes very high and is essentially uncontrollable, owing to the low or zero work hardening rate of aluminum alloys at the process temperature (e.g. about 300° C.) of the pressure-ram-forming operation.

That is to say, at such temperatures the work hardening rate of aluminum alloys is essentially zero and ductility (i.e., forming limit) decreases with increasing strain rate. Thus, the ability to make the desired final shaped container product is lessened as the strain rate of the forming operation increases and the ductility of aluminum decreases.

In accordance with a further important feature of the invention, positive fluid pressure is applied to the outside of the preform in the die cavity, simultaneously with the application of positive fluid pressure to the inside of the preform. These external and internal positive fluid pressures are respectively provided by two independently controlled pressure systems. The external positive fluid pressure can be conveniently supplied by connecting an independently controllable source of positive fluid pressure to the aforementioned exhaust opening or passage, so as to maintain a positive pressure in the volume between the die and the expanding preform.

Figure 7:
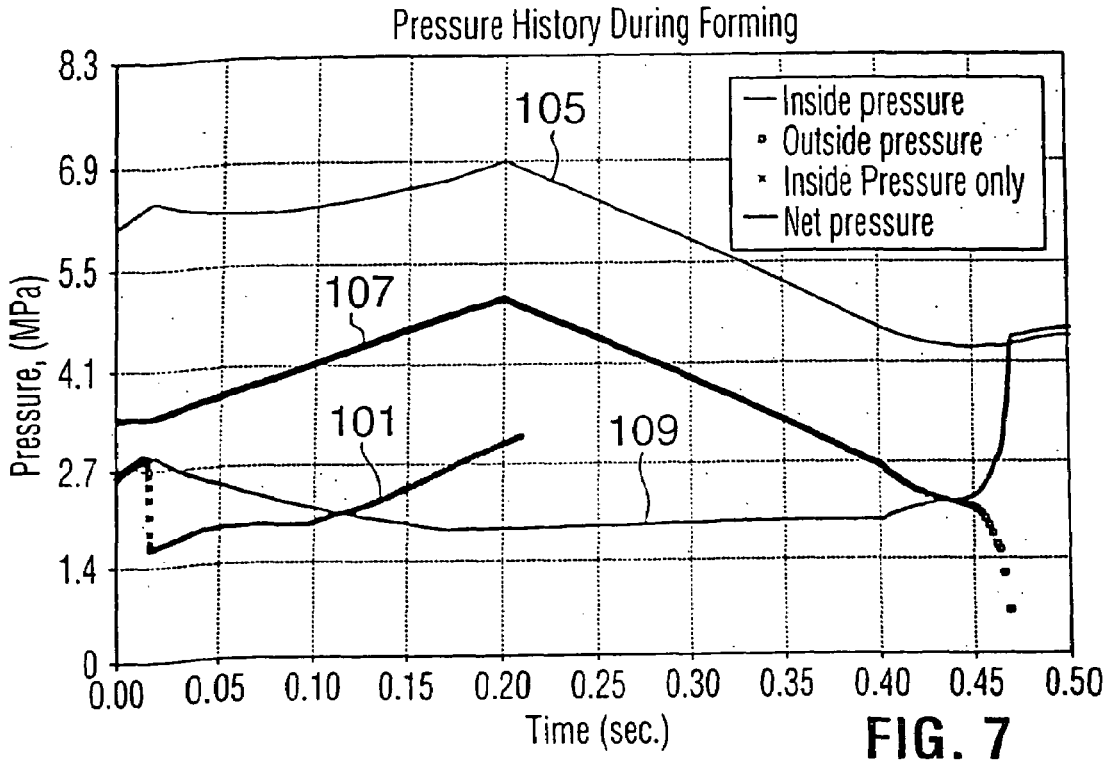
FIG. 7 is a graph of pressure variation over time (using arbitrary time units) illustrating the feature of simultaneously applying independently controllable internal and external positive fluid pressures to the preform in the die cavity and comparing therewith internal pressure variation (as in FIG. 3) in the absence of external positive pressure.
Figure 8:
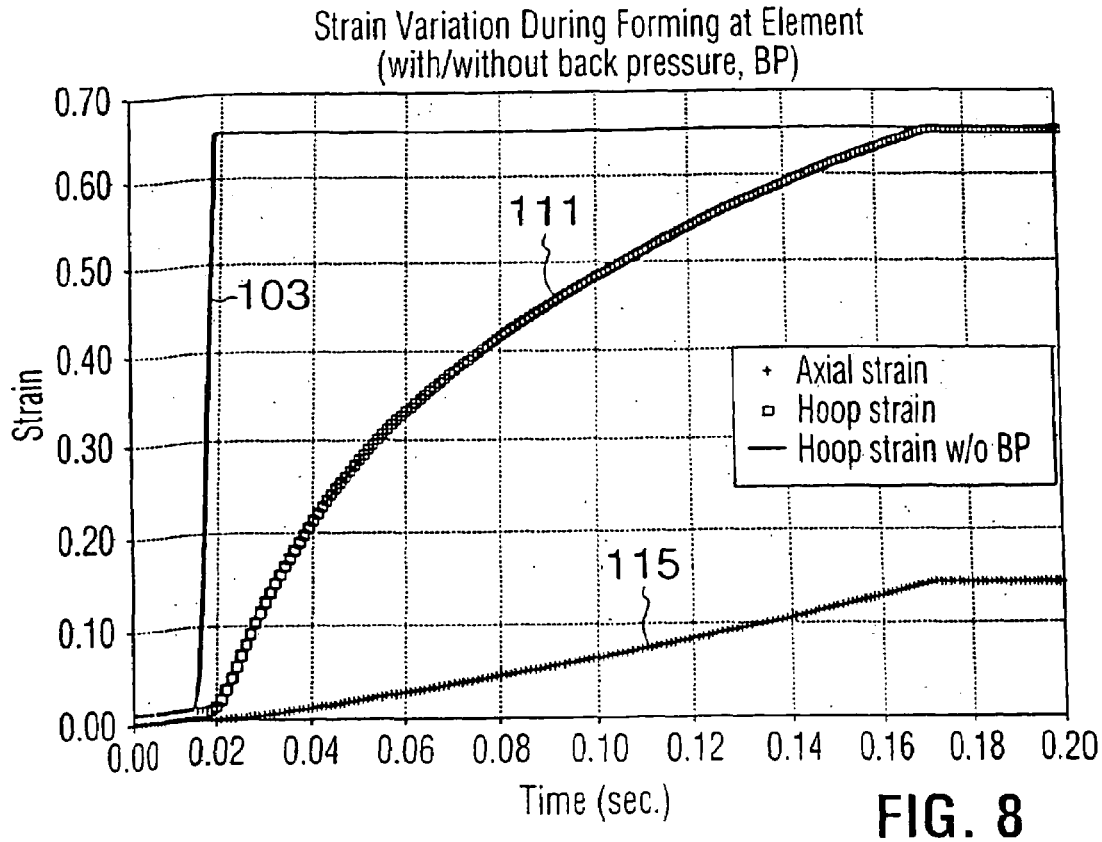
FIG. 8 is a graph of strain variation over time, derived from finite element analysis, showing strain for one particular position (element) under the two different pressure conditions compared in FIG. 7.

FIGS. 7 and 8 compare the pressure vs. time and strain vs. time histories for pressure-ram-forming a container with and without positive external pressure control (the term "strain" herein refers to elongation per unit length produced in a body by an outside force). Line 101 of FIG. 7 corresponds to the line designated "Pressure" in FIG. 3, for the case where there is no external positive fluid pressure acting on the preform; line 103 of FIG. 8 represents the resulting strain for one particular position (element) as determined by FEA. Clearly the strain is almost instantaneous in this case, implying very high strain rates and very short times to expand the preform into contact with the die wall. In contrast, lines 105, 107 and 109 of FIG. 7 respectively represent internal positive fluid pressure, external positive fluid pressure, and the differential between the two, when both internal and external pressures are controlled, i.e., when external and internal positive fluid pressures, independently controlled, are simultaneously applied to the preform in the die cavity; the internal pressure is higher than the external pressure so that there is a net positive internal-external pressure differential as needed to effect expansion of the preform. Line 111 in FIG. 8 represents the hoop strain (strain produced in the horizontal plane around the circumference of the preform as it is expanding) for the independently controlled internal-external pressure condition represented by lines 105, 107 and 109; it will be seen that the hoop strain shown by line 111 reaches the same final value as that of line 103 but over a much longer time and thus at a much lower strain rate. Line 115 in FIG. 8 represents axial strain (strain produced in the vertical direction as the preform lengthens).

By simultaneously providing independently controllable internal and external positive fluid pressures acting on the preform in the die cavity, and varying the difference between these internal and external pressures, the forming operation remains completely in control, avoiding very high and uncontrollable strain rates. The ductility of the preform, and thus the forming limit of the operation, is increased for two reasons. First, decreasing the strain rate of the forming operation increases the inherent ductility of the aluminum alloy. Second, the addition of external positive pressure decreases (and potentially could make negative) the hydrostatic stress in the wall of the expanding preform. This could reduce the detrimental effect of damage associated with microvoids and intermetallic particles in the metal. The term "hydrostatic stress" herein refers to the arithmetic average of three normal stresses in the x, y and z directions.

The feature of the invention thus described enhances the ability of the pressure-ram-forming operation to successfully make aluminum containers in bottle shapes and the like, by enabling control of the strain rate of the forming operation and by decreasing the hydrostatic stress in the metal during forming.

The selection of pressure differential is based on the material properties of the metal from which the preform is made. Specifically, the yield stress and the work-hardening rate of the metal must be considered. In order for the preform to flow plastically (i.e., inelastically), the pressure differential must be such that the effective (Mises) stress in the preform exceeds the yield stress. If there is a positive work-hardening rate, a fixed applied effective stress (from the pressure) in excess of the yield stress would cause the metal to deform to a stress level equal to that applied effective stress. At that point the deformation rate would approach zero. In the case of a very low or zero work-hardening rate, the metal would deform at a high strain rate until it either came into contact with the wall of the mold (die) or fracture occurred. At the elevated temperatures anticipated for the PRF process, the work-hardening rate of aluminum alloys is low to zero.

Examples of gases suitable for use to supply both the internal and external pressures include, without limitation, nitrogen, air and argon, and any combinations of these gases.

The plastic strain rate at any point in the wall of the preform, at any point in time, depends only on the instantaneous effective stress, which in turn depends only on the pressure differential. The choice of external pressure is dependent on the internal pressure, with the overall principle to achieve and control the effective stress, and thus the strain rate, in the wall of the preform.

Figure 9:
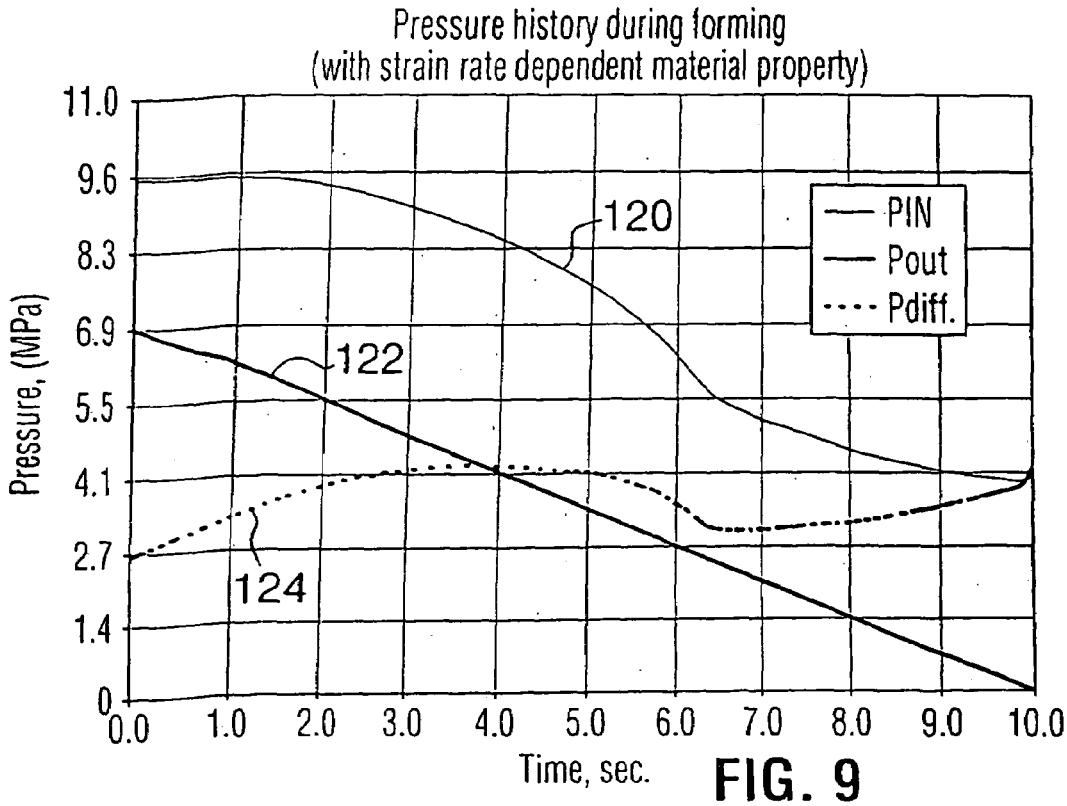
FIG. 9 is a graph similar to FIG. 7 illustrating a particular control mechanism that can be used in the forming process when internal and external positive fluid pressures are simultaneously applied to the preform in the die cavity.

FIG. 9 shows a different control mechanism that can be used in the forming process. Finite element simulations have been used to optimize the process. In FIG. 9, line 120 represents internal pressure (Pin) acting on the preform, line 122 represents external pressure (Pout) acting on the preform, and line 124 represents the pressure differential (Pdiff=Pin—Pout). This figure shows the pressure history from one control method. In this case, the fluid mass in the internal cavity is kept constant and the pressure in the external cavity (outside the preform) is decreasing linearly. Strain rate-dependent material properties are also included in the simulation. This latter control mechanism is currently preferred because it results in a simpler process.

Figure 10:
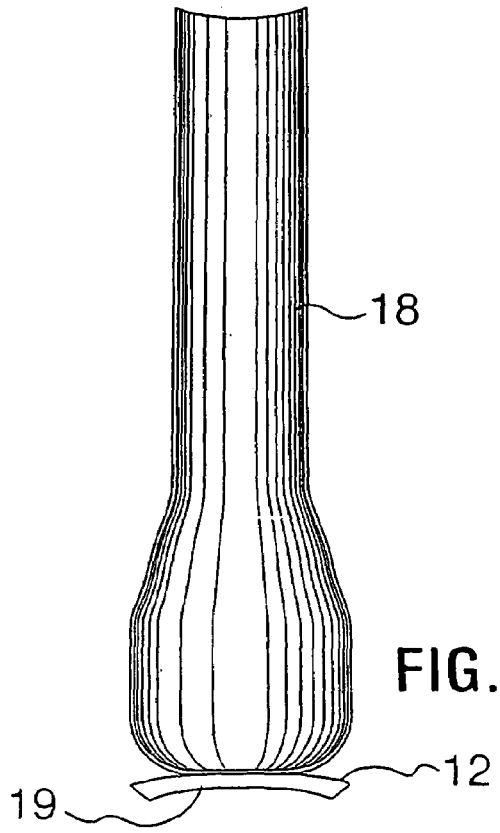
FIG. 10 is a schematic illustration of an expanding preform using a heated punch.

FIG. 10 relates to a further embodiment of the invention where heating is applied to the preform which induces a temperature gradient to the preform. As shown in FIG. 10, the punch 12, is in contact with the bottom of the preform 18 and the punch 12 contains a heating element 19. This heats the preform from the bottom up causing the expansion of the preform to grow from the bottom up when internal pressure is increased.

Figure 11:
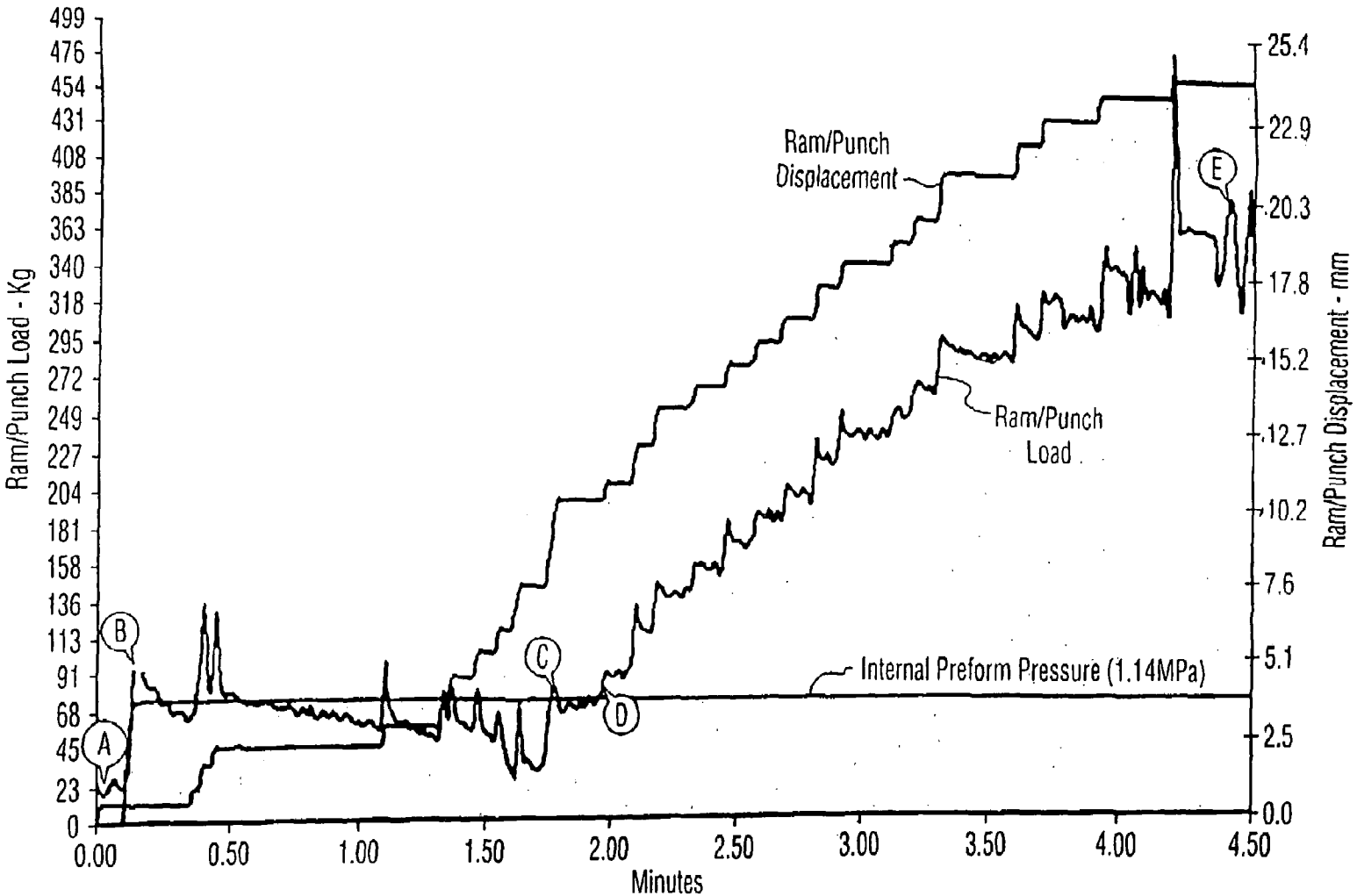
FIG. 11 is a graph showing loadings on the punch, internal pressures and displacements of the punch during expansion of a preform.

FIG. 11 shows graphs illustrating the expansion process. One line of the graph shows the displacements of the ram/punch while the other shows the variations in the load on the ram/punch, both as a function of time. A third line shows the internal pressure in the preform.

At point A the ram is pre-loaded to a compressive load of about 22.7 kg and at point B the preform is internally pressurized and held at a level of 1.14 Mpa. In the procedure illustrated, the position of the ram was stepped between points B and C to maintain a compressive ram load of 68 kg. When the ram load no longer decreased rapidly after an increment in ram position (point C to D), the ramping of the ram was continued to a displacement of about 25 mm and a load of about 454 kg (point E). During the ramping of the ram from point D to point E, the bottom profile of the container was formed simultaneously with the expansion of the preform so that point E represents the completion of the forming of the container.

While the graph of FIG. 11 shows a stepwise procedure, it is also possible to expand and form the preform into a container in one smooth operation, e.g. by utilizing a computerized control of the procedure. The advantage of this procedure is that due to the induced temperature gradient, the expansion proceeds gradually from the bottom to the top as the ram and punch move up. It has been shown that this technique leads to reduced improved formability when compared to the previously described methods in which expansion occurs essentially simultaneously over the entire length of the preform.

While FIG. 10 shows a heating element only within the punch 12, it is possible to provide different heating zones to aid in the forming. For instance, there can be a further separate heater around the top of the preform as well as further separate heating elements within the side walls of the die cavity. By independently manipulating the temperatures in each of these areas, optimal expansion histories are developed for various container designs.

Figure 12:
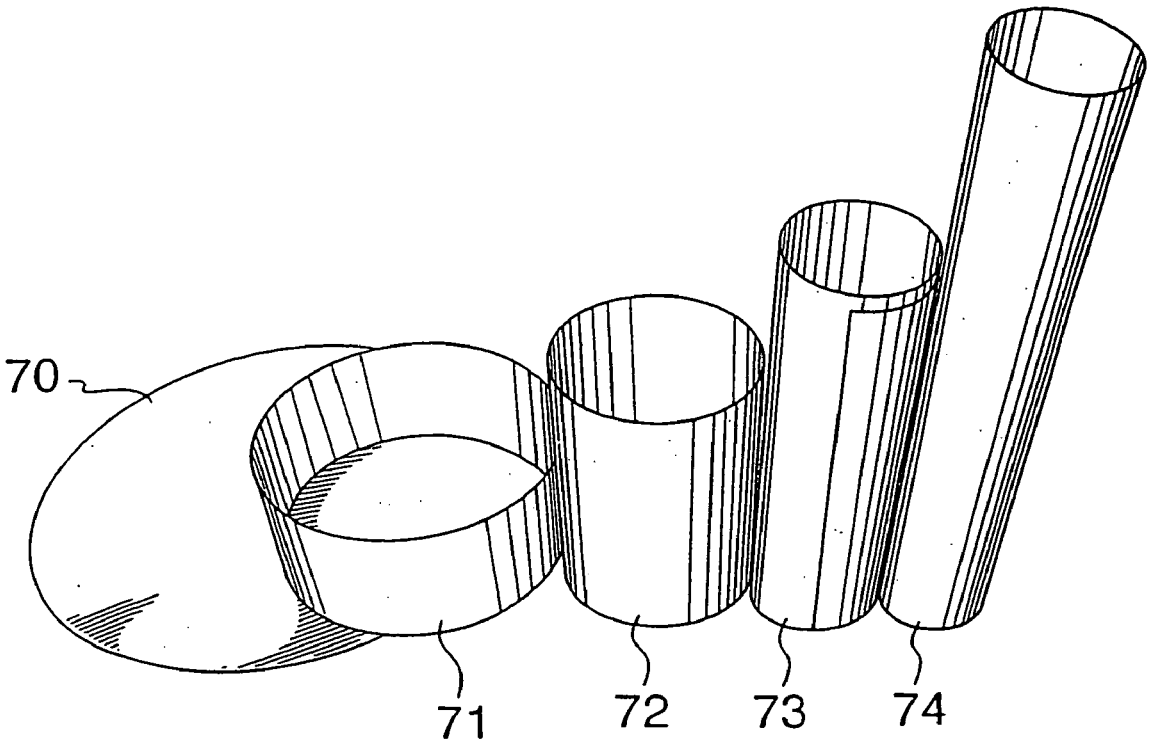
FIG. 12 is a perspective view showing stages in the production of a preform from a flat disc.

FIG. 12 shows a typical sequence in the making of a preform from a flat disc. A standard draw/redraw technique is used with the aluminum sheet 70 being first drawn into a shallow closed end cylinder 71, which is then redrawn into a second cylinder 72 of smaller diameter and longer side wall. Cylinder 72 is then redrawn to form cylinder 73, which is redrawn to form cylinder 74. It will be noted that the cylinder 74 has a long thin configuration.

Figure 13:
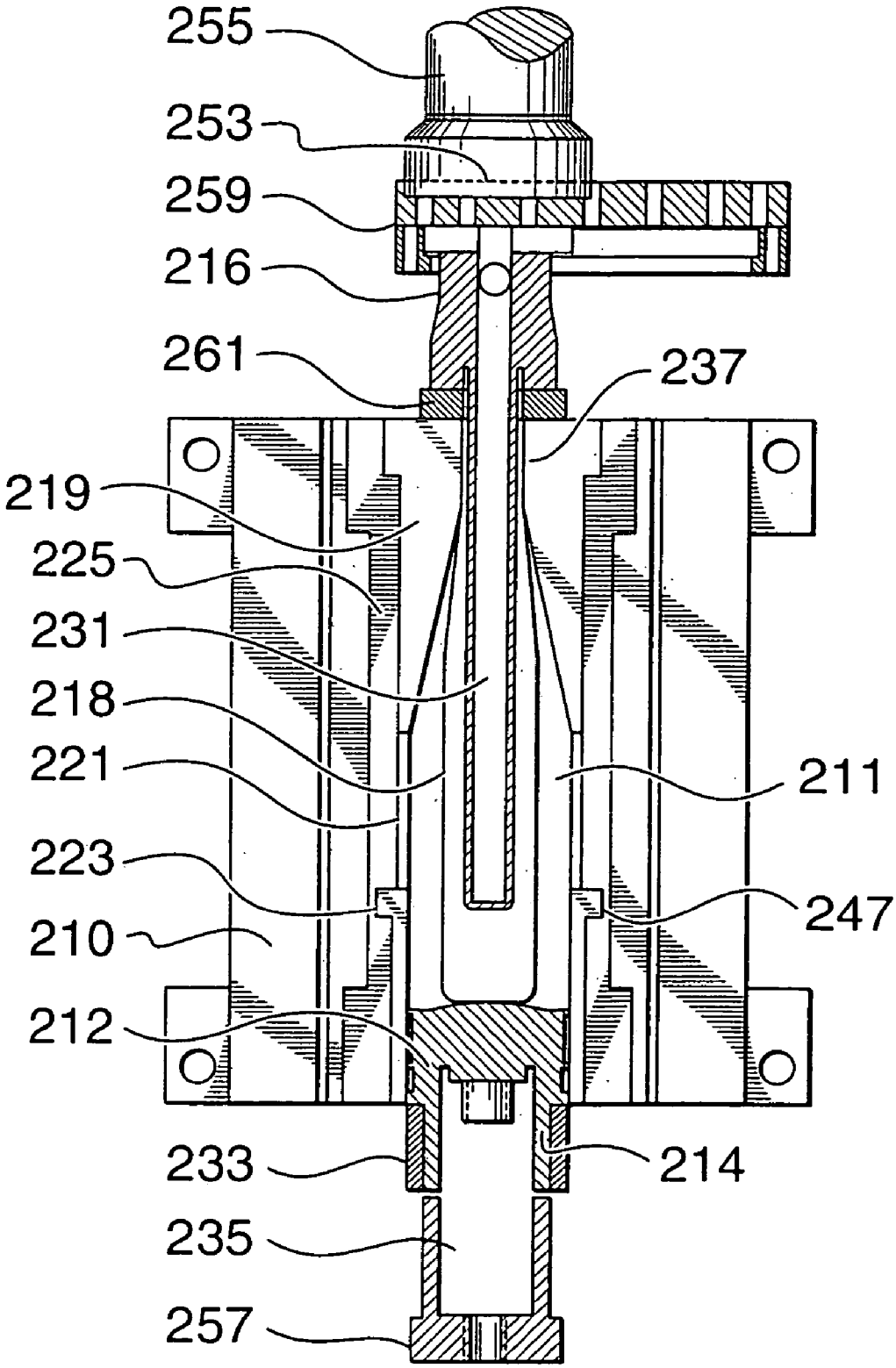
FIG. 13 is an elevational sectional view of an illustrative embodiment of the apparatus of the invention for use in performing the method of the invention.

An embodiment of the apparatus of the invention, for performance of certain embodiments of the method of the invention to form a metal container, is illustrated in FIGS. 13–16. This apparatus includes a split die 210 with a profiled cavity 211 defining an axially vertical bottle shape, a punch 212 contoured to impart a desired container bottom configuration (which may be asymmetric), a backing ram 214 for moving the punch, and a sealing ram 216 for sealing the open upper end of the die cavity and of a metal (e.g. aluminum) container preform 218 when the preform is inserted within the cavity as shown in FIG. 13, as well as additional components and instrumentalities described below.

In the split die of the apparatus of FIGS. 13–16, interchangeable primary inserts 219 and secondary profile sections or inserts 221 and 223 fit onto the inner surface of a split insert holder 225 received in the split main die member 210. These sections can serve as stencils, having inner surfaces formed with relief patterns (the term "relief" being used herein to refer to both positive and negative relief) for applying decoration or embossing to the metal container as it is being formed. Each insert 219, 221 and 223 is itself a split insert, formed in two separate pieces (219*a*, 219*b*; 221*a*, 221*b*; 223*a*, 223*b*) that are respectively fitted in the two separate split insert holder halves 225*a*, 225*b*, which are in turn respectively received in axially vertical facing semi-cylindrical channels of the two split main die member halves 210*a*, 210*b*.

Gas is fed to the die through two separate channels for both internal and external pressurization of the preform. The supply of gas to the interior of the die cavity externally of the preform may be effected through mating ports in the die structure 210 and insert holder 225, from which there is an opening or channel to the cavity interior (for example) through an insert 219, 221 or 223; such an opening or channel will produce a surface feature on the formed container, and accordingly is positioned and configured to be unobtrusive, e.g. to constitute a part of the container surface design. Two groups of heating elements 227 and 229 under independent temperature control may be respectively incorporated in the upper and lower portions of the die, to provide a controlled temperature gradient during operation. A heating element 231 is mounted inside the preform, coaxially therewith; this heating element can eliminate any need to preheat the gas that, as in other embodiments of the present method (described above), is supplied to the interior of the preform to expand the preform. Another heating element 233 is provided for the backing ram 214 (thereby serving as a means for heating the punch), with a temperature isolation ring 235 to prevent overheating of the hydraulics and load cells located in adjacent portions of the equipment.

The foregoing features of the apparatus of FIGS. 13–16 enable enhanced rapidity of die changes, reduced energy costs and increased production rates. Desirably, for economy of construction and operation, the only heating elements provided and used may be the coaxial element 231 and the backing ram element 233.

As is additionally illustrated in the apparatus of FIGS. 13–16, screw threads or lugs (to enable attachment of a screw closure cap) and/or a neck ring can be formed in a neck portion of the container during and as a part of the PRF procedure itself, rather than by a separate necking step, again for the sake of increasing production rates. This is accomplished by creating a negative thread or lug pattern in the inner surface portion of the split die corresponding to the neck of the formed container, so that as the preform expands (in the neck region of the die cavity) the thread or lug relief pattern is imparted thereto. For such thread-forming operation, the preform (or at least its neck portion) is dimensioned to be smaller in diameter than the neck of the final formed container.

Figure 14:
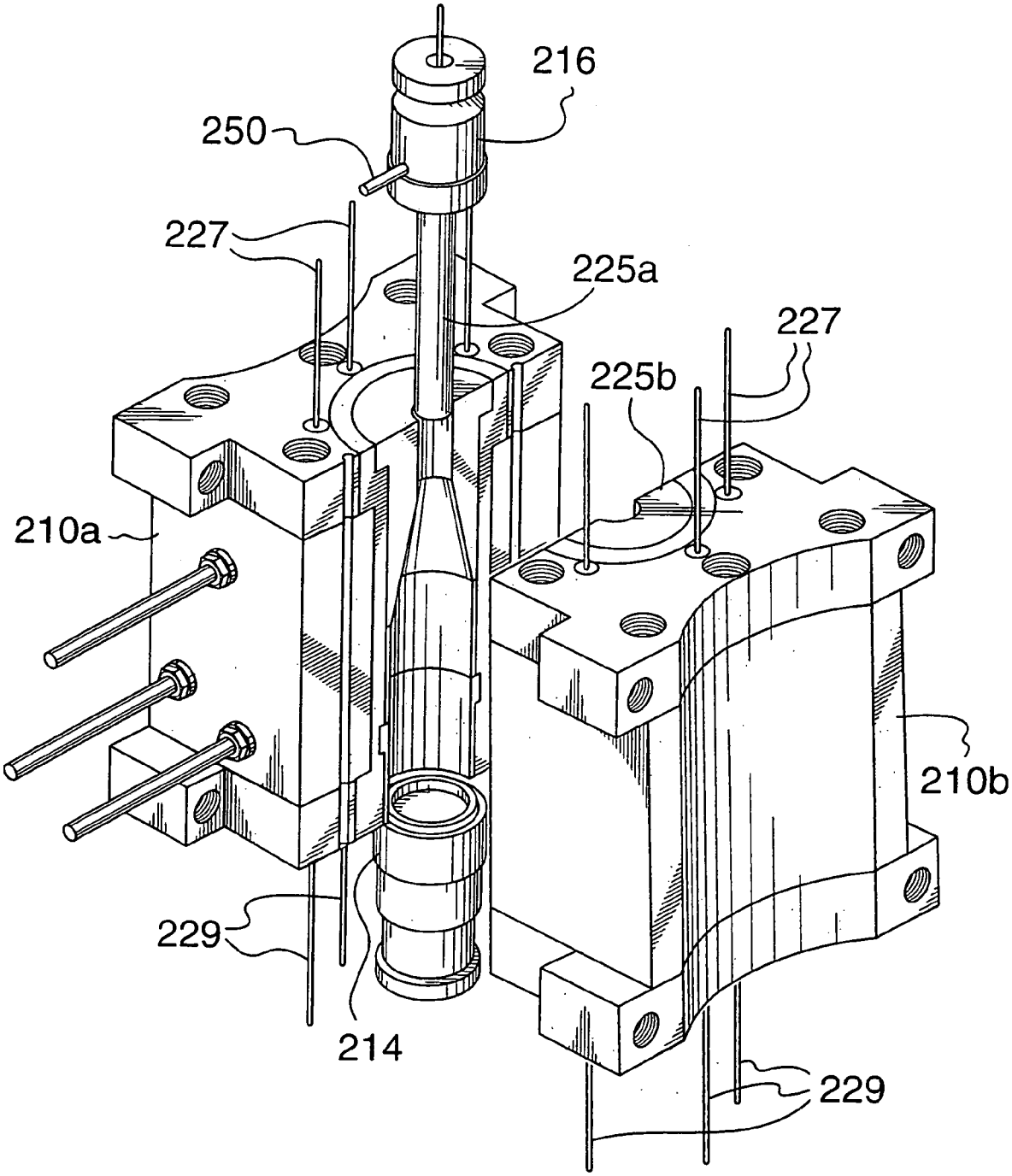
FIG. 14 is a perspective view, partly exploded, of the apparatus of FIG. 13.
Figure 15A:
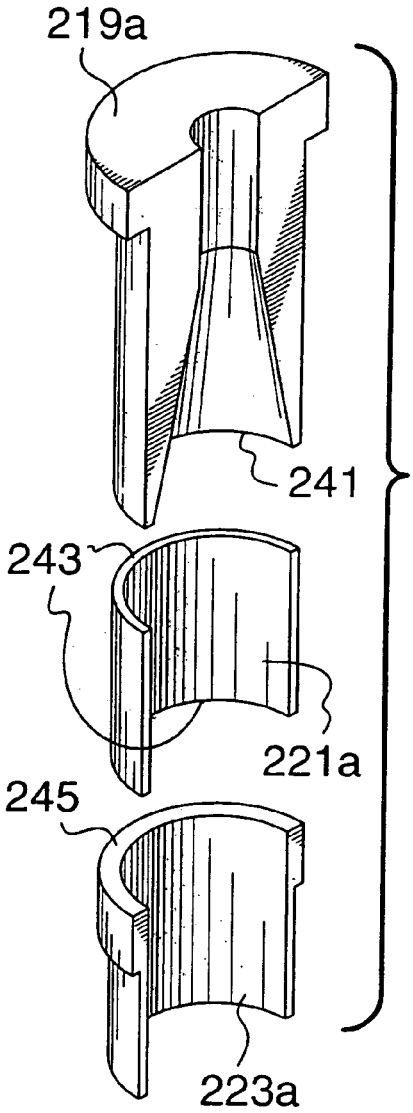
FIGS. 15A, 15B and 15C are perspective views of one half of the split die of the apparatus of FIGS. 13 and 14 respectively illustrating the split inserts of the split die half in exploded view, the split insert holder, and the inserts and holder in assembled relation.
Figure 15B:
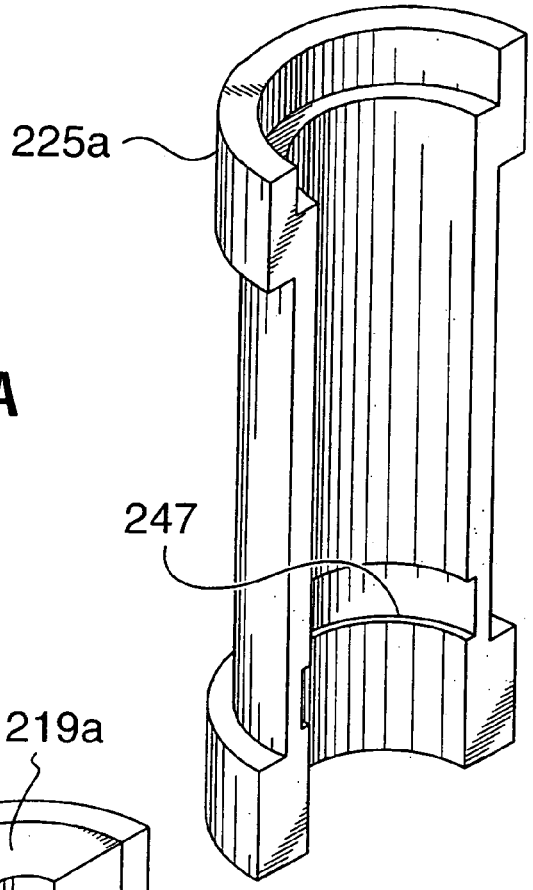
Figure 15C:
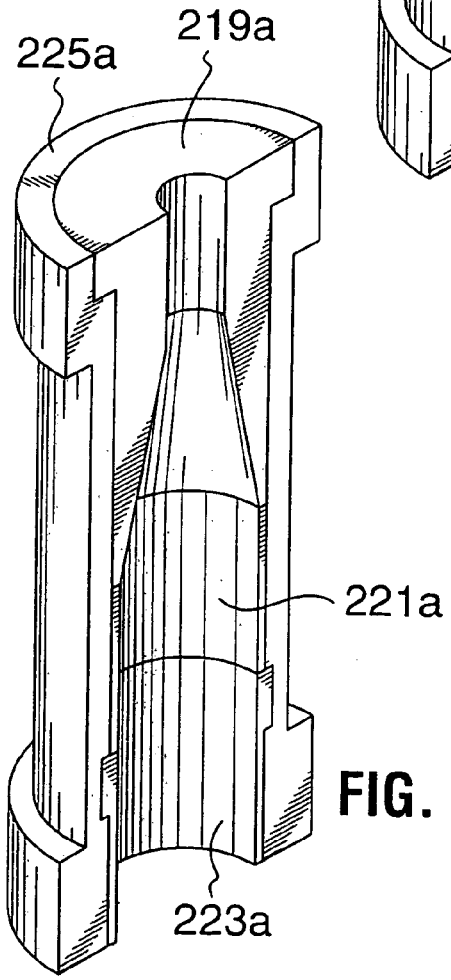
Figure 16:
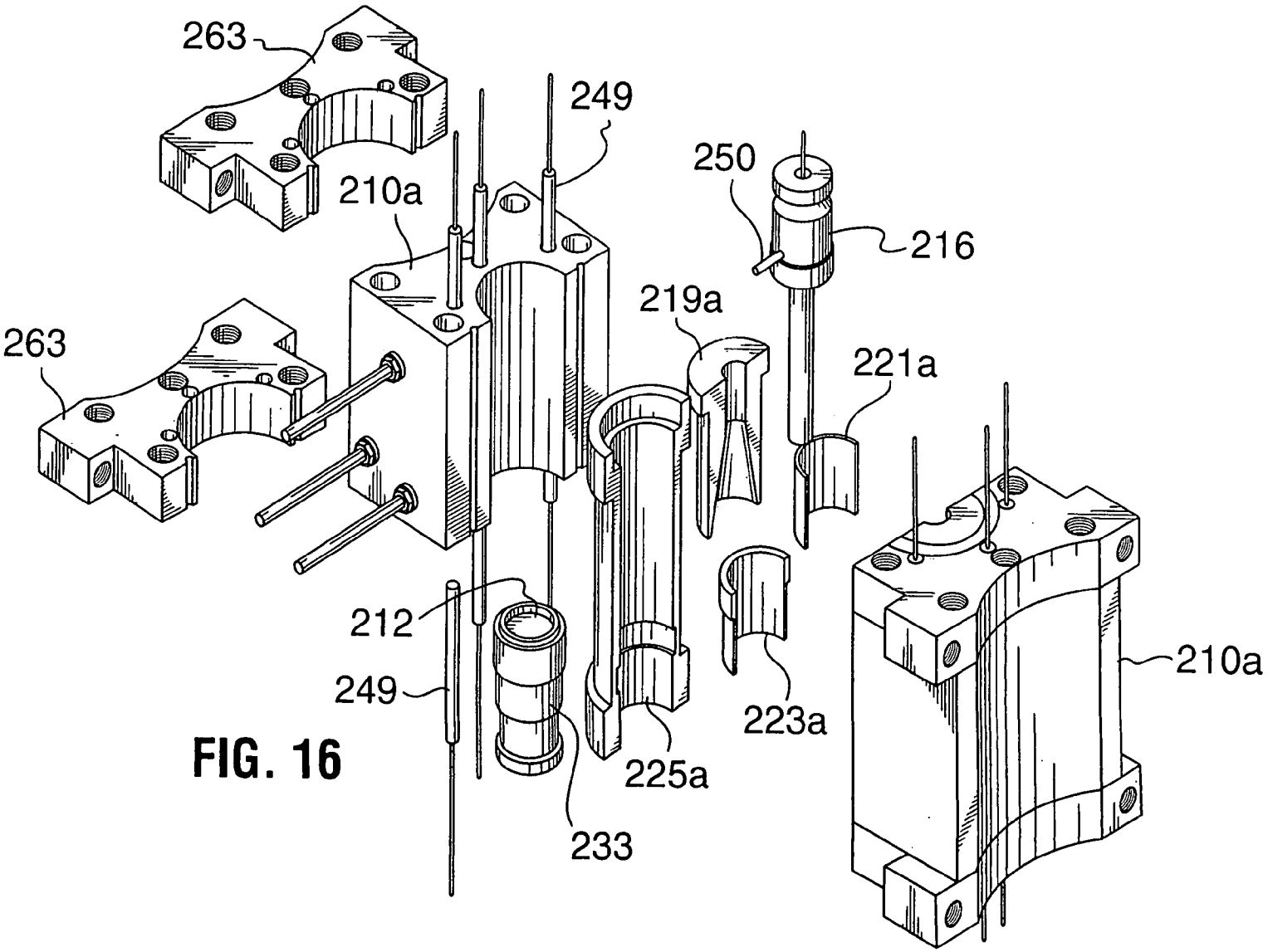
FIG. 16 is a fully exploded perspective view of the apparatus of FIGS. 13 and 14.

Stated with particular reference to FIGS. 14–16, the insert holder is constituted of two mirror-image halves 225*a*, 225*b* each having an axially vertical and generally semi-cylindrical inner surface. The primary insert 219 and the two secondary split inserts 221 and 223 are disposed in contiguous, tandem succession along the axis of the die cavity, each half of each secondary insert being fitted into one half of the split insert holder so that, when the two halves of the insert holder are brought together in facing relation, the two halves of each split insert are in facing register with each other. The primary and secondary inserts mate with each other at their horizontal edges 241, 243, 245 and have outer surfaces that interfit with features such as ledges 247 formed in the inner surfaces of the halves of the split insert holder. Together, the inserts constitute the entire die wall defining the shape of the container to be formed.

Each of the primary profile insert halves 219*a* and 219*b* has an inner surface defining half of the upper portion, including the neck, of the desired container shape, such as a bottle shape. As indicated at 237 in FIG. 13, the neck-forming surface of each half of this primary split insert (in the illustrated embodiment) is contoured as a screw thread for imparting a cap-engaging screw thread to the neck of the formed container. The remainder of the inner surface of the primary split insert may be smooth, to produce a smooth-surfaced container, or textured to produce a container with a desired surface roughness or repeat pattern.

One or both halves of either or both of the two (upper and lower) secondary profile inserts 221 and 223 may have an inner surface configured to provide positive and/or negative relief patterns, designs, symbols and/or lettering on the surface of the formed container. Advantageously, multiple sets of interchangeable inserts are provided, e.g. with surface features differing from each other, for use in producing formed metal containers with correspondingly different designs or surfaces. Tooling changes can then be effected very rapidly and simply by slipping one set of inserts out of the insert holders and substituting another set of inserts that is interchangeable therewith.

Sealing between opposite components of the split die is accomplished by precision machining that eliminates the need for gaskets and rings.

In the embodiment shown, the split die member 210 is heated by twelve rod heaters 249, each half the vertical height of the die set, inserted vertically in the die assembly from the top and bottom, respectively. Heating control is provided in two zones, upper and lower, with independent temperature control systems (not shown) allowing the temperature gradient in the die to be controlled.

The gas for internal and external pressurization of the preform within the die cavity can be preheated by passing through two separate channels in the two component pressure containment blocks (split die member 210). The channel for external pressurization vents into the die cavity, while the channel for internal pressurization vents to the interior of the preform via the sealing ram 216, to which gas is delivered through sealing ram gas port 250.

The heating element 231 is a heater rod attached to the sealing ram and located coaxially with the preform, extending downwardly into the preform, near to the bottom thereof, through the open upper end of the preform, when the sealing ram is in its fully lowered position for performance of a PRF procedure. Element 231 has its own separate temperature control system (not shown). With this arrangement, preheating of the gas may be avoided, enabling elimination of gas preheating equipment and also at least largely avoiding the need to preheat the die components, since only the preform itself needs to be at an elevated temperature. The sealing ram, like the backing ram, is provided with a ceramic temperature isolation ring 253 to prevent overheating of adjacent hydraulics and load cells.

As further shown in FIGS. 13 and 16, the apparatus is also provided with a hydraulic sealing ram adapter 255 and a hydraulic backing ram adapter 257; an isolation ring-sealing ram adapter 259; sealing ram ring 261; and upper and lower pressure containment end caps 263 for each half of the split main die member 210.

A cam system could be used as an alternative to hydraulics for moving the rams.

It is to be understood that the invention is not limited to the procedures and embodiments hereinabove specifically set forth but may be carried out in other ways without departure from its spirit.

What is claimed is:

1. A method of forming a metal container of defined shape and lateral dimensions, comprising (a) disposing a hollow metal preform having a closed end in a die cavity laterally enclosed by a die wall defining said shape and lateral dimensions, with only a single, movable punch, said punch being located at one end of the cavity and translatable into the cavity, the preform closed end being positioned in proximate facing relation to the punch and at least a portion of the preform being initially spaced inwardly from the die wall;

(b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform.

2. A method according to claim 1, wherein the punch is moved into contact with the closed end of the preform before commencing expansion of the preform and the contact is maintained throughout the expansion of the preform.

3. A method according to claim 1, wherein said punch has a contoured surface, the closed end of the preform being deformed so as to conform to said contoured surface.

4. A method according to claim 1, wherein said defined shape is a bottle shape including a neck portion and a body portion larger in lateral dimensions than the neck portion, said die cavity having a long axis, said preform having a long axis and being disposed substantially coaxially with said cavity in step (a), and said punch being translatable along the long axis of the cavity.

5. A method according to claim 4, wherein said punch has a domed contour, and wherein step (c) deforms said closed end of said preform into said domed contour.

6. A method according to claim 4, wherein said die wall comprises a split die separable for removal of the formed container following step (c).

7. A method according to claim 6, wherein said defined shape is asymmetric about said long axis of said cavity.

8. A method according to claim 4, wherein said punch is initially positioned, at the start of step (b), to limit axial lengthening of the preform by said fluid pressure.

9. A method according to claim 4, wherein said preform is an elongated and initially generally cylindrical workpiece having an open end opposite said closed end and is substantially equal in diameter to said neck portion of said bottle shape.

10. A method according to claim 9, wherein said workpiece has sufficient formability to be expandable to said defined shape in a single pressure forming operation.

11. A method according to claim 9, including a preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a), (b) and (c).

12. A method according to claim 1, wherein said preform is an aluminum preform.

13. A method according to claim 1, wherein step (b) comprises simultaneously applying internal positive fluid pressure and external positive fluid pressure to the preform in the cavity, said internal positive fluid pressure being higher than said external positive fluid pressure.

14. A method according to claim 2, wherein heat is applied to the preform by way of heating means in the punch to thereby induce a temperature gradient to the preform commencing at the closed bottom and extending upwardly.

15. A method according to claim 14, wherein heat is applied to the preform by way of heating means in the side walls of the die.

16. A method according to claim 1, wherein the die wall comprises die structure having upper and lower portions and wherein heat is applied to the preform by two groups of heating elements respectively incorporated in the upper and lower portions of the die structure and under independent temperature control for controlling temperature gradient in the preform.

17. A method according to claim 1, wherein heat is applied to the preform by a heating element disposed within the preform substantially coaxially therewith.

18. A method according to claim 17 wherein heat is further supplied to the preform by heating the punch.

19. A method according to claim 1, wherein said fluid pressure is provided by gas.

20. A method of forming a metal container of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal gas pressure to expand the preform outwardly into substantially full contact with the die wall, thereby to impart said defined shape and lateral dimensions to the preform, said gas pressure exerting force, on said closed end, directed toward said one end of the cavity; and (c) translating the punch into the cavity to engage and displace the closed end of the preform in a direction opposite to the direction of force exerted by gas pressure thereon, deforming the closed end of the preform.

21. A method according to claim 20, wherein steps (b) and (c) are performed at a temperature higher than 100° C.

22. A method according to claim 20, wherein steps (b) and (c) are performed at a temperature of about 300° C.

23. A method according to claim 20, wherein said gas is selected from the group consisting of nitrogen, air and argon.

24. A method of forming a metal container of defined shape and lateral dimensions, comprising the steps of (a) disposing a hollow metal preform having a closed end in a die cavity laterally enclosed by a die wall defining said shape and lateral dimensions, the preform closed end being positioned in facing relation to one end of the cavity and at least a portion of the preform being initially spaced inwardly from the die wall, and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity, wherein step (b) comprises simultaneously applying internal positive fluid pressure and external positive fluid pressure to the preform in the cavity, said internal positive fluid pressure being higher than said external positive fluid pressure, and including controlling strain rate in the preform by independently controlling the internal and external positive fluid pressures to which the preform is simultaneously subjected for varying the differential between said internal positive fluid pressure and said external positive fluid pressure.

25. A method of forming a metal container of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform, wherein step (b) comprises simultaneously applying internal positive fluid pressure and external positive fluid pressure to the preform in the cavity, said internal positive fluid pressure being higher than said external positive fluid pressure, and wherein said metal is aluminum.

26. A method according to claim 25, wherein said fluid pressure is provided by gas.

27. A method according to claim 26, wherein steps (b) and (c) are performed at a temperature higher than 100° C.

28. A method according to claim 27, wherein said gas is selected from the group consisting of nitrogen, air and argon.

29. A method according to claim 25, including controlling strain rate in the preform by independently controlling the internal and external positive fluid pressures to which the preform is simultaneously subjected for varying the differential between said internal positive fluid pressure and said external positive fluid pressure.

30. A method according to claim 29, wherein said internal positive fluid pressure is provided by gas.

31. A method according to claim 30, wherein both said internal and external positive fluid pressures are provided by gas.

32. A method according to claim 30, wherein steps (b) and (c) are performed at a temperature higher than 100° C.

33. A method according to claim 30, wherein said gas is selected from the group consisting of nitrogen, air and argon.

34. A method of forming an aluminum container of defined shape and lateral dimensions, comprising (a) disposing a hollow aluminum preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal gas pressure to expand the preform outwardly into substantially full contact with the die wall, thereby to impart said defined shape and lateral dimensions to the preform, said gas pressure exerting force, on said closed end, directed toward said one end of the cavity; and (c) translating the punch into the cavity to engage and displace the closed end of the preform in a direction opposite to the direction of force exerted by gas pressure thereon, deforming the closed end of the preform, further including the step of making the preform from aluminum sheet having a recrystallized or recovered microstructure with a gauge in a range of about 0.25 to about 1.5 mm, prior to performance of step (a).

35. A method according to claim 34, wherein steps (b) and (c) are performed at a temperature higher than 100° C.

36. A method according to claim 35, wherein said gas is selected from the group consisting of nitrogen, air and argon.

37. A method according to claim 34, wherein step (b) comprises simultaneously applying internal positive fluid pressure and external positive fluid pressure to the preform in the cavity, said internal positive fluid pressure being higher than said external positive fluid pressure, and including controlling strain rate in the preform by independently controlling the internal and external positive fluid pressures to which the preform is simultaneously subjected for varying the differential between said internal positive fluid pressure and said external positive fluid pressure.

38. A method of forming an aluminum container of defined shape and lateral dimensions, comprising (a) disposing a hollow aluminum preform having a closed end in a die cavity laterally enclosed by a die wall defining said shape and lateral dimensions, the preform closed end being positioned in facing relation to one end of the cavity and at least a portion of the preform being initially spaced inwardly from the die wall; and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity;

further including the step of making the preform from aluminum sheet having a recrystallized or recovered microstructure with a gauge in a range of about 0.25 to about 1.5 mm, prior to performance of step (a).

39. A method of forming an aluminum container of defined shape and lateral dimensions, comprising (a) disposing a hollow aluminum preform having a closed end in a die cavity laterally enclosed by a die wall defining said shape and lateral dimensions, the preform closed end being positioned in facing relation to one end of the cavity and at least a portion of the preform being initially spaced inwardly from the die wall; and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity;

wherein said defined shape is a bottle shape including a neck portion and a body portion larger in lateral dimensions than the neck portion, said die cavity having a long axis, said preform having a long axis and being disposed substantially coaxially with said cavity in step (a);

wherein said preform is an elongated and initially generally cylindrical workpiece having an open end opposite said closed end and is substantially equal in diameter to said neck portion of said bottle shape; and including preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a) and (b).

40. A method according to claim 39, further including the step of making the preform from aluminum sheet having a recrystallized or recovered microstructure with a gauge in a range of about 0.25 to about 1.5 mm, prior to performance of step (a).

41. Apparatus for forming a metal container of defined shape and lateral dimensions from a hollow metal preform having a closed end, comprising (a) die structure providing a die cavity for receiving the preform therein with at least a portion of the preform being initially spaced inwardly from the die wall and the preform closed end facing one end of the cavity, said cavity having a die wall defining said shape and lateral dimensions;

(b) a fluid pressure supply for subjecting a preform within the cavity to internal fluid pressure to expand the preform outwardly into substantially full contact with the die wall, thereby to impart said defined shape and lateral dimensions to the preform, said fluid pressure exerting force, on said closed end, directed toward said one end of the cavity;

(c) the die cavity having a second end opposed to said one end and an axis extending therebetween;

(d) the die wall comprising a split die including a plurality of split inserts disposed in tandem along said axis for defining successive portions of said shape and separable for removal of the formed container from the cavity.

42. Apparatus as defined in claim 41, wherein the die structure comprises a split holder within which the split inserts are removably and replaceably received, for maintaining the inserts in fixed die-cavity-defining position during expansion of a preform within the cavity.

43. Apparatus as defined in claim 42, wherein at least one of said inserts has an inner surface bearing a relief feature for imparting a corresponding relief feature to the container.

44. Apparatus as defined in claim 43, further comprising a group of interchangeable inserts having inner surfaces respectively bearing different relief features, from which one or more split inserts are selected for insertion in said holder.

45. Apparatus as defined in claim 41, further including separate gas-feeding channels for respectively feeding gas to the interior of the preform and to the die cavity externally of the preform, to apply internal and external positive fluid pressures to a preform within the die cavity.

46. Apparatus as defined in claim 41, wherein the die structure has upper and lower portions and two groups of heating elements respectively incorporated in the upper and lower portions of the die structure and under independent temperature control for controlling temperature gradient in the preform.

47. Apparatus as defined in claim 41, further including a heating element insertable within a preform in the die cavity substantially coaxially therewith.

48. Apparatus as defined in claim 41, wherein the neck portion of the defined shape includes a screw thread or lug for securing a screw closure to the formed container and wherein the die wall has a neck portion with a thread or lug formed therein for imparting a thread or lug to a preform disposed in the die cavity.

49. A method of forming a hollow metal article of defined shape and lateral dimensions, comprising (a) disposing a hollow metal preform having a closed end in a die cavity laterally enclosed by a die wall defining said shape and lateral dimensions, with only a single, movable punch, said punch being located at one end of the cavity and translatable into the cavity, the preform closed end being positioned in proximate facing relation to the punch and at least a portion of the preform being initially spaced inwardly from the die wall;

(b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform.

50. A method of forming a hollow metal article of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal gas pressure to expand the preform outwardly into substantially full contact with the die wall, thereby to impart said defined shape and lateral dimensions to the preform, said gas pressure exerting force, on said closed end, directed toward said one end of the cavity; and (c) translating the punch into the cavity to engage and displace the closed end of the preform in a direction opposite to the direction of force exerted by gas pressure thereon, deforming the closed end of the preform.

51. A method of forming a hollow metal article of defined shape and lateral dimensions, comprising the steps of (a) disposing a hollow metal preform having a closed end in a die cavity laterally enclosed by a die wall defining said shape and lateral dimensions, the preform closed end being positioned in facing relation to one end of the cavity and at least a portion of the preform being initially spaced inwardly from the die wall, and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity, wherein step (b) comprises simultaneously applying internal positive fluid pressure and external positive fluid pressure to the preform in the cavity, said internal positive fluid pressure being higher than said external positive fluid pressure, and including controlling strain rate in the preform by independently controlling the internal and external positive fluid pressures to which the preform is simultaneously subjected for varying the differential between said internal positive fluid pressure and said external positive fluid pressure.

52. A method of forming a hollow metal article of defined shape and lateral dimensions, comprising (a) disposing a hollow metal preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity; and (c) translating the punch into the cavity to engage and displace the closed end of the preform in a direction opposite to the direction of force exerted by fluid pressure thereon, deforming the closed end of the preform, wherein step (b) comprises simultaneously applying internal positive fluid pressure and external positive fluid pressure to the preform in the cavity, said internal positive fluid pressure being higher than said external positive fluid pressure, and wherein said metal is aluminum.

53. A method of forming a hollow aluminum article of defined shape and lateral dimensions, comprising (a) disposing a hollow aluminum preform having a closed end in a die cavity laterally enclosed by a die wall defining said shape and lateral dimensions, with a punch located at one end of the cavity and translatable into the cavity, the preform closed end being positioned in proximate facing relation to the punch and at least a portion of the preform being initially spaced inwardly from the die wall;

(b) subjecting the preform to internal gas pressure to expand the preform outwardly into substantially full contact with the die wall, thereby to impart said defined shape and lateral dimensions to the preform, said gas pressure exerting force, on said closed end, directed toward said one end of the cavity; and (c) translating the punch into the cavity to engage and displace the closed end of the preform in a direction opposite to the direction of force exerted by gas pressure thereon, deforming the closed end of the preform, further including the step of making the preform from aluminum sheet having a recrystallized or recovered microstructure with a gauge in a range of about 0.25 to about 1.5 mm, prior to performance of step (a).

54. A method of forming a hollow aluminum article of defined shape and lateral dimensions, comprising (a) disposing a hollow aluminum preform having a closed end in a die cavity laterally enclosed by a die wall defining said shape and lateral dimensions, the preform closed end being positioned in facing relation to one end of the cavity and at least a portion of the preform being initially spaced inwardly from the die wall; and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity;

further including the step of making the preform from aluminum sheet having a recrystallized or recovered microstructure with a gauge in a range of about 0.25 to about 1.5 mm, prior to performance of step (a).

55. A method of forming a hollow aluminum article of defined shape and lateral dimensions, comprising (a) disposing a hollow aluminum preform having a closed end in a die cavity laterally enclosed by a die wall defining said shape and lateral dimensions, the preform closed end being positioned in facing relation to one end of the cavity and at least a portion of the preform being initially spaced inwardly from the die wall; and (b) subjecting the preform to internal fluid pressure to expand the preform outwardly into substantially full contact with the die wall, thereby to impart said defined shape and lateral dimensions to the preform, said fluid pressure exerting force, on said closed end, directed toward said one end of the cavity;

wherein said defined shape is a bottle shape including a neck portion and a body portion larger in lateral dimensions than the neck portion, said die cavity having a long axis, said preform having a long axis and being disposed substantially coaxially with said cavity in step (a);

wherein said preform is an elongated and initially generally cylindrical workpiece having an open end opposite said closed end and is substantially equal in diameter to said neck portion of said bottle shape; and including preliminary steps of placing the workpiece in a die cavity smaller than the first-mentioned die cavity and subjecting the workpiece therein to internal fluid pressure to expand the workpiece to an intermediate size and shape smaller than said defined shape and lateral dimensions, before performing steps (a) and (b).

56. Apparatus for forming a hollow metal article of defined shape and lateral dimensions from a hollow metal preform having a closed end, comprising (a) die structure providing a die cavity for receiving the preform therein with at least a portion of the preform being initially spaced inwardly from the die wall and the preform closed end facing one end of the cavity, said cavity having a die wall defining said shape and lateral dimensions;

(b) a fluid pressure supply for subjecting a preform within the cavity to internal fluid pressure to expand the preform outwardly into substantially full contact with the die wall, thereby to impart said defined shape and lateral dimensions to the preform, said fluid pressure exerting force, on said closed end, directed toward said one end of the cavity;

(c) the die cavity having a second end opposed to said one end and an axis extending therebetween;

(d) the die wall comprising a split die including a plurality of split inserts disposed in tandem along said axis for defining successive portions of said shape and separable for removal of the formed container from the cavity.

57. Apparatus for forming a hollow metal article of defined shape and lateral dimensions from a hollow metal preform having a closed end, comprising (a) die structure providing a die cavity for receiving the preform therein with at least a portion of the preform being initially spaced inwardly from the die wall and the preform closed end facing one end of the cavity, said cavity having a die wall defining said shape and lateral dimensions;

(b) a punch located at one end of the cavity and translatable into the cavity such that the closed end of a preform received within the cavity is positioned in proximate facing relation to the punch;

(c) a fluid pressure supply for subjecting a preform within the cavity to internal fluid pressure to expand the preform outwardly into substantially full contact with the die wall, thereby to impart said defined shape and lateral dimensions to the preform, said fluid pressure exerting force, on said closed end, directed toward said one end of the cavity;

(d) the die cavity having a second end opposed to said one end and an axis extending therebetween;

(e) the die wall comprising a split die including a plurality of split inserts disposed in tandem along said axis for defining successive portions of said shape and separable for removal of the formed container from the cavity.

* * * * *